United States Patent [19]

Davern et al.

[11] Patent Number: 4,645,112

[45] Date of Patent: Feb. 24, 1987

[54] RIVETING MACHINE

[75] Inventors: John W. Davern, North Tonawanda; Daniel D. Cook, Lancaster, both of N.Y.

[73] Assignee: Gemcor Engineering Corp., Buffalo, N.Y.

[21] Appl. No.: 720,851

[22] Filed: Apr. 8, 1985

Related U.S. Application Data

[62] Division of Ser. No. 332,824, Dec. 21, 1981, Pat. No. 4,515,302.

[51] Int. Cl.[4] ..... B21J 15/10

[52] U.S. Cl. ..... 227/112; 221/248; 227/51

[58] Field of Search ..... 221/248; 227/8, 51, 227/58, 152, 120, 130, 112

[56] References Cited

U.S. PATENT DOCUMENTS

| | | | |
|---|---|---|---|
| 2,732,554 | 1/1956 | Knott | 227/112 |
| 3,275,047 | 9/1966 | Kulman | 144/32 |
| 3,324,697 | 6/1969 | Reiley | 227/112 X |
| 3,494,393 | 2/1970 | Casanon | 144/32 |
| 3,643,129 | 3/1972 | Erlich | 227/112 |
| 3,918,706 | 11/1975 | Craft | 406/87 X |
| 3,946,926 | 3/1976 | Willis | 227/112 |
| 4,165,132 | 8/1979 | Hassan et al. | 406/87 X |
| 4,363,573 | 12/1982 | Ginther et al. | 221/278 X |

FOREIGN PATENT DOCUMENTS

| | | | |
|---|---|---|---|
| 0686750 | 1/1940 | Fed. Rep. of Germany | 221/278 |
| 2148396 | 4/1973 | Fed. Rep. of Germany | 227/112 |
| 55-11476 | 1/1980 | Japan | 406/87 |
| 1419371 | 12/1975 | United Kingdom . | |

OTHER PUBLICATIONS

O'Neill et al., *Annular Orientor*, IBM, Technical Disclosure Bulletin, vol. 20, No. 2, P593rd, 7/1977.

*Primary Examiner*—Paul A. Bell

*Attorney, Agent, or Firm*—Christel, Bean & Linihan

[57] ABSTRACT

An automatic drilling and riveting machine comprising a frame having a main body portion and having a front end portion disposed in a first plane, means for defining a drilling and riveting axis in the frame closely adjacent and substantially parallel to the first plane, and a ram and clamp assembly carried by the frame for holding a workpiece relative to the frame in a second plane substantially perpendicular to the first plane during drilling and riveting and for applying force for heading a rivet inserted in the workpiece. A transfer assembly carried by the frame main body portion selectively moves a drilling means and a rivet inserting and forming means each into and out of positional alignment with the drilling and riveting axis and when in such alignment toward and away from the workpiece for drilling a rivet-receiving hole in the workpiece and for inserting a rivet in the hole and forming a head on the inserted rivet in co-operation with the holding and force applying means. A rivet receiving and holding means receives rivet blanks from a supply tube and maintains them in a predetermined orientation for subsequent injection into the rivet inserting and forming means independent of the orientation of the machine.

19 Claims, 22 Drawing Figures

Fig. 7.
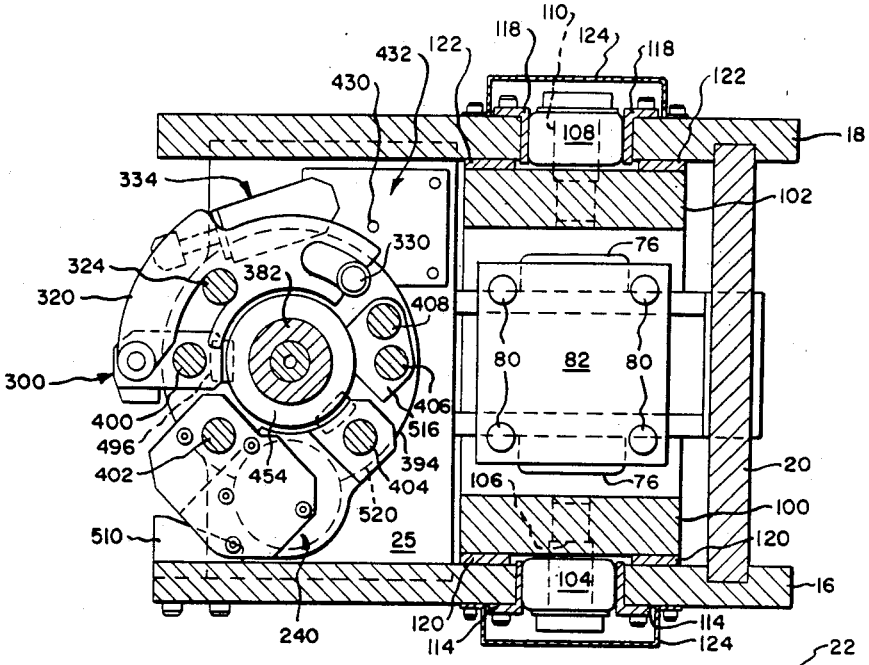
Fig. 9.
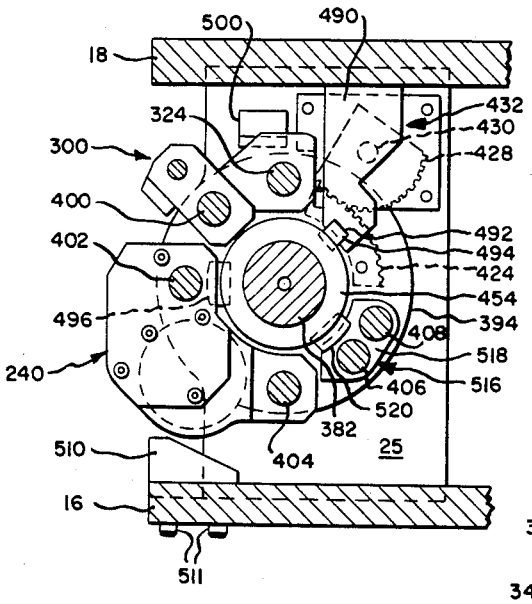
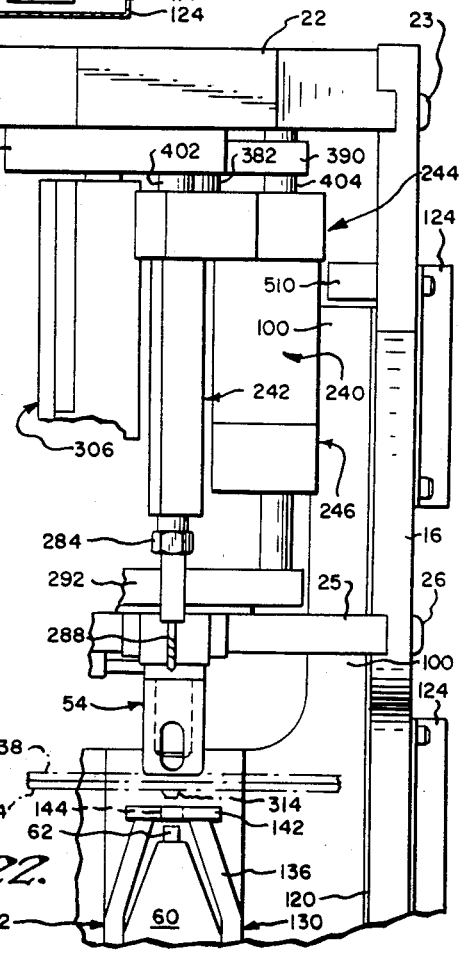
Fig. 22.

Fig. 10.
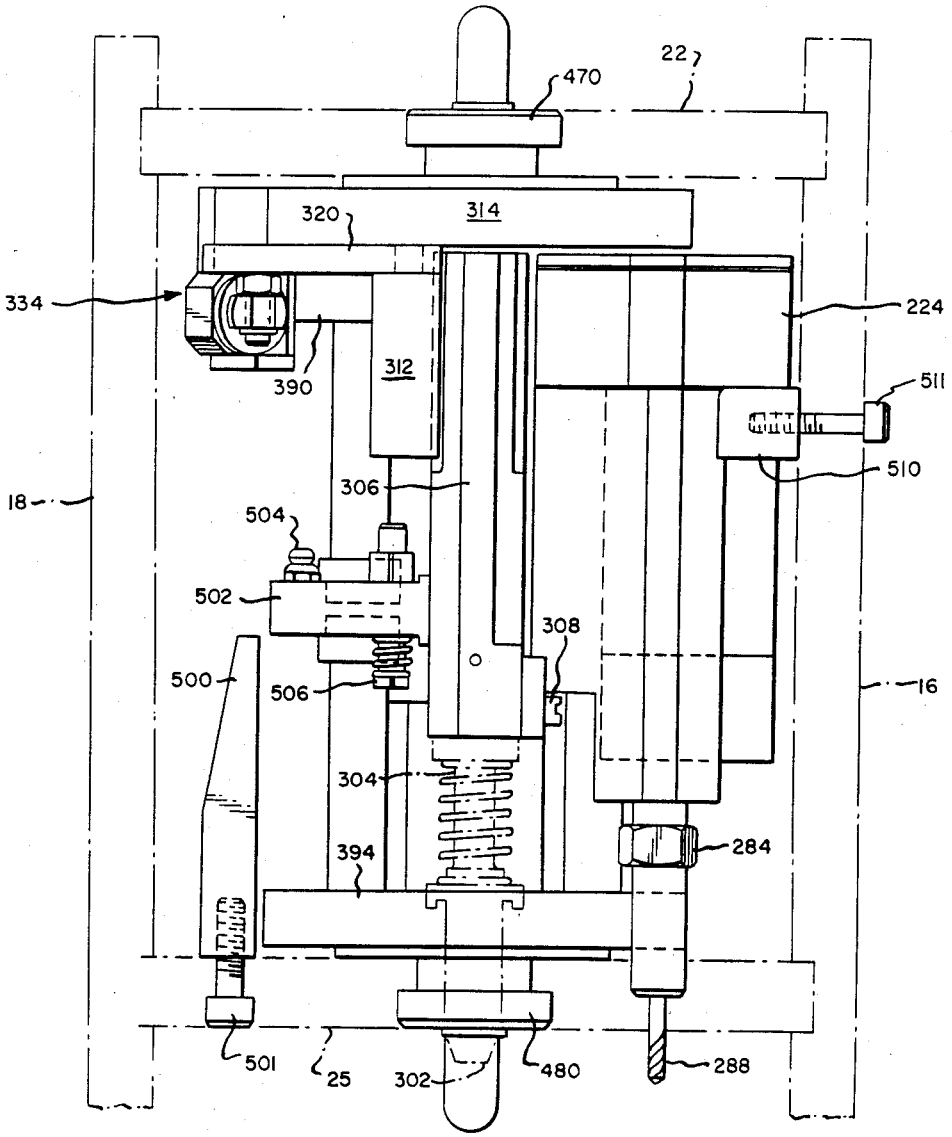
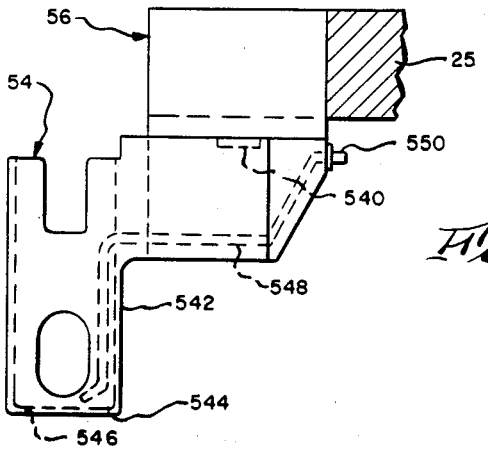
Fig. 11.

RIVETING MACHINE

This is a divisional of application Ser. No. 332,824, filed Dec. 21, 1981, now U.S. Pat. No. 4,515,302.

BACKGROUND OF THE INVENTION

This invention relates to riveting machines, and more particularly to a new and improved riveting machine for automatic drilling and riveting which is portable and operable in close clearance situations.

In prior art automatic riveting machines, the location of the drilling and riveting tools in the machine structure requires clearance between the rivet location in the workpiece and any structure extending from the plane of the workpiece. As a result, there are close clearance porduction operations which still are drilled and riveted by hand. In addition, prior art drilling and riveting machines are large in size and therefore not portable with the result that the work must be brought to the machine.

It would, therefore, be highly desirable to provide a riveting machine for automatic drilling and riveting which is operable in close clearance situations and which is small in size and light in weight so as to be portable. Related to portability are the added desirable characteristics of the machine being operable in any positional orientation and the capability of bringing the machine to the work. Such an automatic drilling and riveting machine would find advantageous use in riveting airplane bulkheads and inside fuselage sections, inside cylindrical ducts, through windows and portholes, truck roof caps and flanges on cargo decks, to mention just a few applications.

SUMMARY OF THE INVENTION

It is, therefore, a primary object of this invention to provide a new and improved riveting machine for automatic drilling and riveting.

It is a further object of this invention to provide such a riveting machine which is operable in close-clearance situations.

It is a further object of this invention to provide such a riveting machine which is small in size and relatively light in weight so as to be portable.

It is a further object of this invention to provide such a riveting machine which is operable in any positional orientation.

It is a further object of this invention to provide such a riveting machine which can be taken to the work to be drilled and riveted.

It is a further object of this invention to provide such a riveting machine which is effective in operation and convenient and economical to manufacture and maintain.

The present invention provides a riveting machine comprising a frame having a main body portion and having a front end portion disposed in a first plane, means for defining a drilling and riveting axis in the frame closely adjacent and substantially parallel to the first plane, and means carried by the frame for holding a workpiece relative to the frame in a second plane substantially perpendicular to the first plane during drilling and riveting and for applying force for heading a rivet inserted in the workpiece. A transfer means carried by the frame main body portion selectively moves a drilling means and a rivet inserting and forming means each into and out of positional alignment with the drilling and riveting axis and when in such alignment toward and away from the workpiece for drilling a rivet-receiving hole in the workpiece and for inserting a rivet in the hole and forming a head on the inserted rivet in cooperation with the holding and force applying means. A rivet receiving and holding means maintains rivet blanks in a predetermined orientation for injection to the rivet inserting and forming means irregardless of the orientation of the machine.

The foregoing and additional advantages and characterizing features of the present invention will become clearly apparent upon a reading of the ensuing detailed description together with the included drawing wherein:

BRIEF DESCRIPTION OF THE DRAWING FIGURES

FIG. 7 is a sectional view taken about on line 7—7 in FIG. 6;

FIG. 9 is a fragmentary sectional view taken about on line 9—9 in FIG. 8;

FIG. 10 is a front end elevational view similar to FIG. 3 and with parts removed showing the drilling means in a rest position and the rivet inserting and forming means in positional alignment with the drilling and riveting axis of the machine;

FIG. 11 is an elevational view with parts removed a movable pressure foot of the machine for contacting one side of a workpiece;

FIG. 22 is a front elevational view of the machine similar to FIG. 3 but with some parts removed and showing the machine in an initial or start condition.

DETAILED DESCRIPTION OF THE ILLUSTRATED EMBODIMENT

Figure 2:
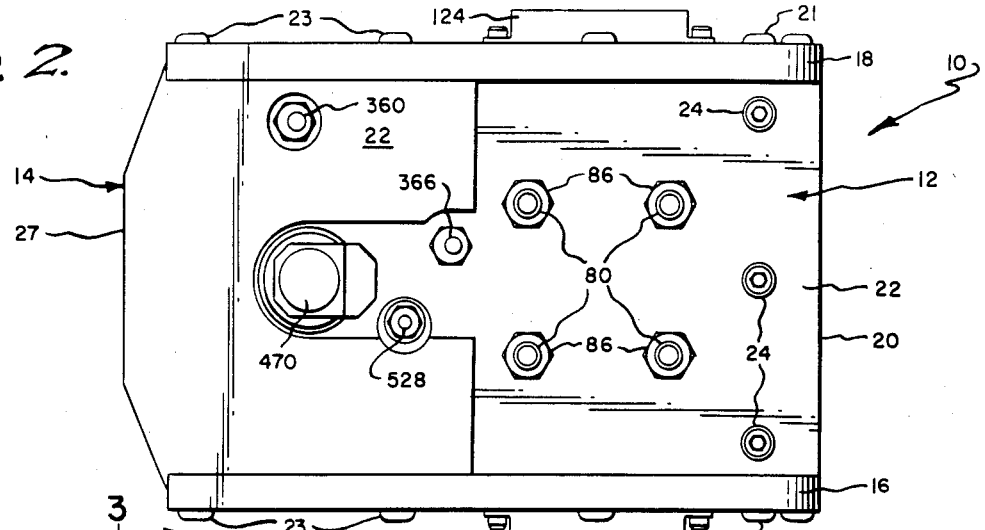
FIG. 2 is a top plan view thereof taken about on line 2—2 in FIG. 1.
Figure 1:
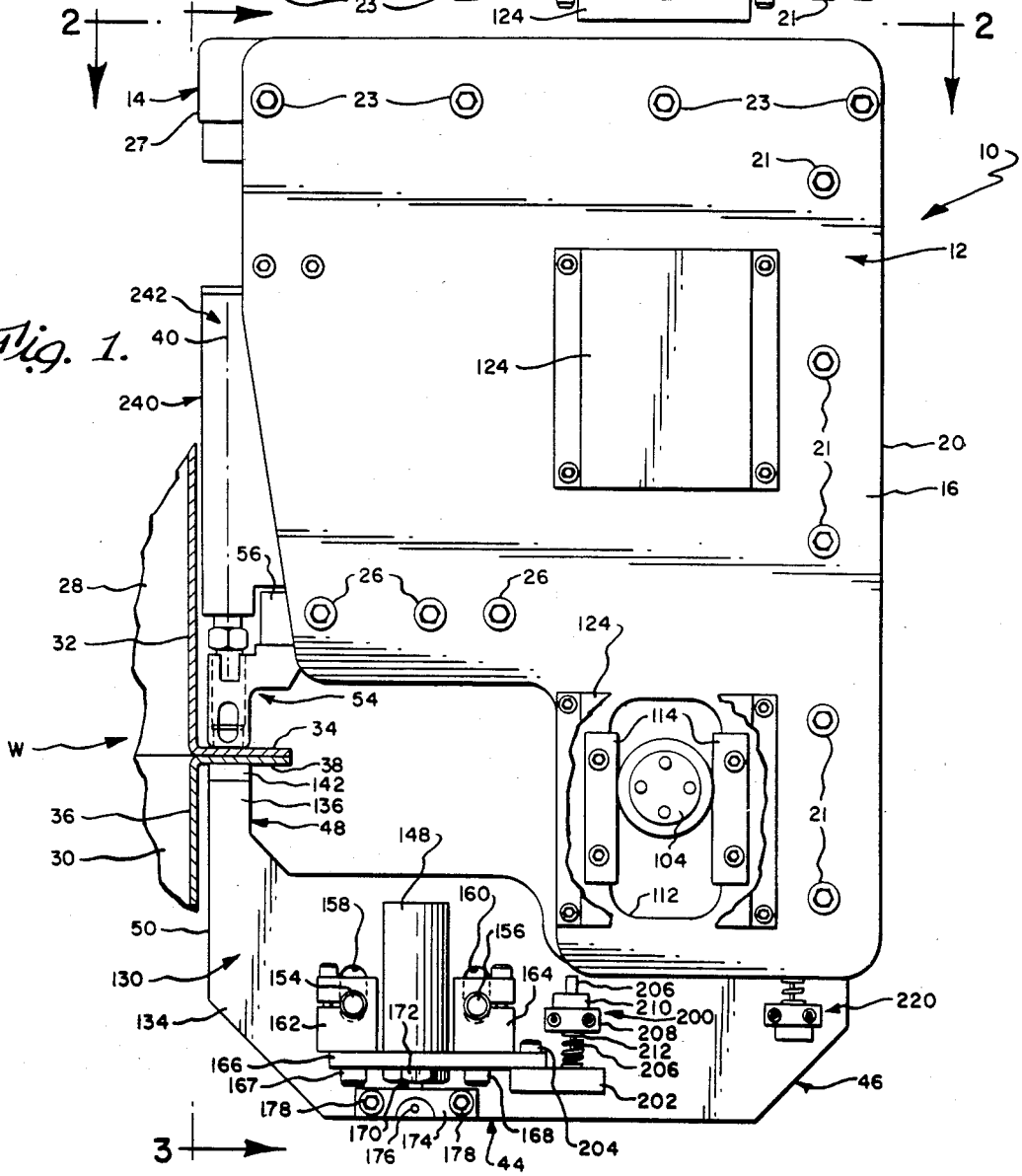
FIG. 1 is a side elevational view of an automatic drilling and riveting machine according to the present invention shown in position for drilling and riveting a workpiece in a close-clearance situation.
Figure 3:
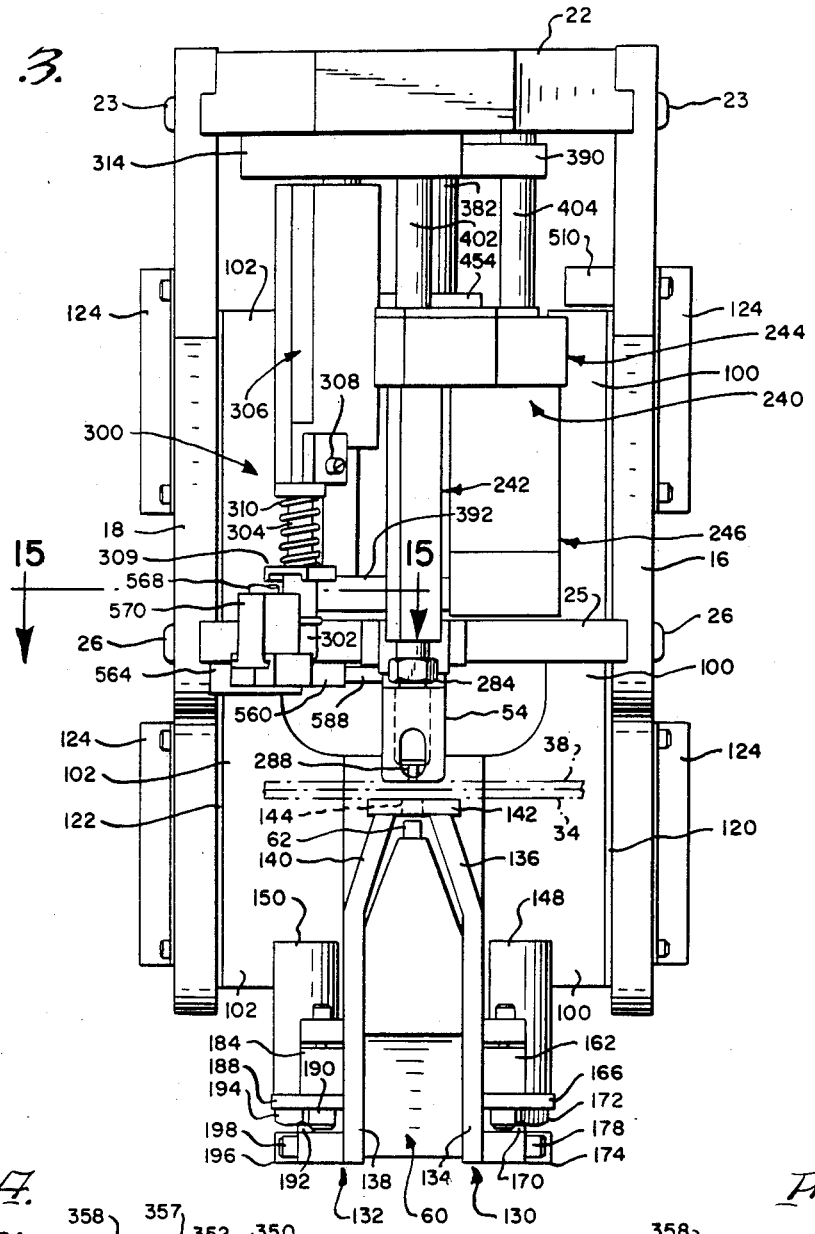
FIG. 3 is a front end elevational view thereof taken about on line 3—3 in FIG. 1.

Referring now to FIGS. 1–3, the automatic drilling and riveting machine 10 according to the present invention comprises a frame having a main body portion generally designated 12 and having a front end portion generally designated 14. The overall framework of the machine includes a pair of sidewalls 16 and 18, a rearwall 20 anchored to sidewalls 16,18 by screws 21 a top wall 22 anchored to sidewalls 16,18 by screws 23 and to rearwall 20 by screws 24 and a bottom wall 25 anchored to sidewalls 16,18 by screws 26. The frame front end portion 14 includes a forwardly facing planar surface 27 which is disposed in a first plane containing that surface.

In FIGS. 1–3 the machine 10 is shown in a generally upright position wherein the first plane containing the frame front end portion is vertically disposed. During use, machine 10 could be supported in spaced relation above a work surface or structure by means of a bracket extending from the structure and fixed to rear end wall 20. Machine 10 also is readily useable with articulating arm balances, heavy duty robots or custom-built positioners and manipulators, any of which would be connected to the machine in a suitable manner, typically on the end plate 20. Advantageously, machine 10 can be used for drilling and riveting in any positional orientation or attitude, for example on its side, completely inverted relative to the position shown in FIGS. 1–3, or in any intermediate position. The structure and characteristics of the machine permitting such universal orientation will be described in detail further on in the specification.

Machine 10 is shown in FIGS. 1–3 in operative association with a workpiece to be drilled and riveted, generally designated W. The illustrative workpiece shown comprises an assembly of two structural members 28 and 30. In particular, member 28 includes a planar wall portion 32 and a flange 34 extending outwardly therefrom at a right angle thereto. Similarly, member 30 includes a planar wall portion 36 and a flange 38 extending outwardly therefrom at a right angle thereto. In the assembly, walls 32 and 36 are disposed in the same plane and flanges 34,38 are in abutting relation for being drilled and riveted together. Flanges 34,38 are in contact along a second plane which is disposed substantially perpendicular to the first plane containing the frame front end portion.

The machine 10 of the present invention further comprises means for defining or establishing a drilling and riveting axis 40 i.e. a work axis, in the frame closely adjacent and substantially parallel to the first plane in which the frame front end portion 14 is disposed. The manner and means by which the drilling and riveting axis 40 is established in the machine will be described in detail presently. In the operational state of the machine 10 illustrated in FIGS. 1 and 3, one of the machine tools, i.e. the drilling means, is in positional alignment with the drilling and riveting in axis 40 in a manner which will be described presently. By way of example, in an illustrative machine, the distance between the first plane containing the frame front end portion 14 and the drilling and riveting axis 40 is about ½ inch. As a result, machine 10 is particularly suited for drilling and riveting in close clearance situations. One such situation is illustrated in FIG. 1 wherein the walls 32,36 of the assembly present an obstruction extending at an angle to the plane containing the abutting surfaces of flanges 34,48 to be riveted. As illustrated in FIG. 1, the machine frame front end portion 14 can be moved closely adjacent the wall 32 of the assembly thereby enabling drilling and riveting to a occur at locations in the flanges 34,38 closely spaced from the walls 32,36.

The automatic drilling and riveting machine 10 according to the present invention further comprises means carried by the machine frame for holding a workpiece relative to the frame in a second plane substantially perpendicular to the first plane during drilling and riveting and for applying force for heading a rivet inserted in the workpiece. As shown in FIG. 1, the workpiece comprising the abutting flanges 34,38 to be drilled and riveted is disposed in a second plane which is substantially perpendicular to the first plane containing the frame front end portion 14. The workpiece holding and force applying means comprises a ram and clamp means generally designated 44 having a first portion 46 movably carried by the frame main body portion 12 and having a second portion 48 moved into and out of operative contact with one side of the workpiece, in the present illustration the lower side of flange 38 as viewed in FIG. 1. The second portion 48 is located between the frame front end portion 14 and frame main body portion 12 as shown in FIG. 1, and portion 48 is intersected by the drilling and riveting axis 40. In particular, portion 48 has a forward surface 50 as viewed in FIG. 1 which does not extend beyond the plane containing the frame front end portion 14. The workpiece holding and force applying means also comprises a holding means generally designated 54 in FIG. 1, also called a pressure foot, operatively connected to the frame and movable into and out of contact with the opposite side of the workpiece, i.e. the upper surface of flange 34 as viewed in FIG. 1, for applying a holding force to the opposite side of the workpiece. Briefly, pressure foot 54 is moved into and out of contact with the workpiece by motive means 56, for example a pneumatic cylinder, and pressure foot 54 terminates in a planar surface for contacting the workpiece. The body of pressure foot 54 is hollow and the planar surface has an opening therein to accommodate the tools for drilling and riveting in a manner which will be described in detail presently. In addition, the pressure foot 54 has a central axis coincident with the drilling and riveting axis 40.

Figure 6:
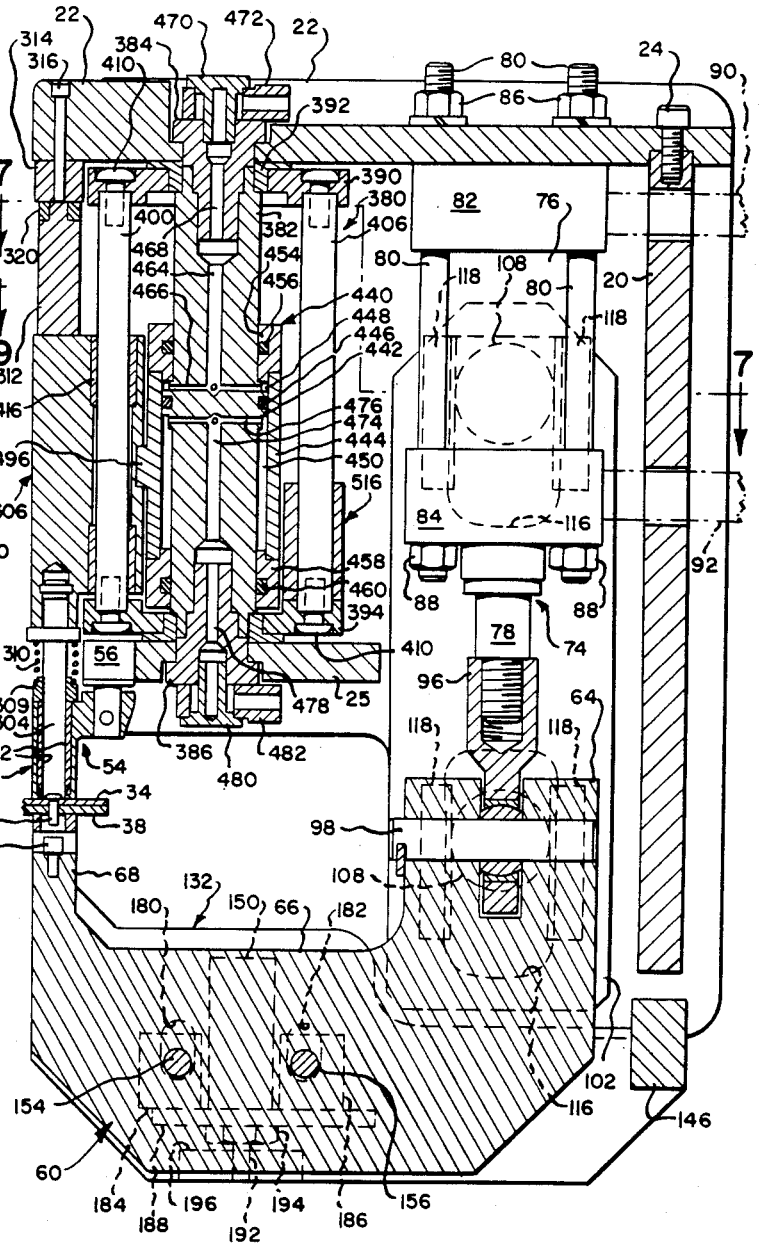
FIG. 6 is a longitudinal sectional view of the machine of FIGS. 1-3 with parts thereof shown in positions corresponding to a rivet inserting and forming mode of operation.

The ram and clamp means 44 includes a ram generally designated 60 in FIGS. 3 and 6 which is mounted in the frame main body portion 12 for movement toward and away from the one side of the workpiece, in the present illustration to the lower side of flange 38 as viewed in FIGS. 1 and 6. Ram 60 has a formation 62 thereon, also called an upset button, for contacting the end of a rivet inserted in the workpiece to form the head thereon. In the machine shown, ram 60 is a one-piece structure having a first section 64 movably mounted in the frame main body portion 12 and extending in a direction substantially parallel to the work axis 40, a second section 66 extending from the first section 64 at substantially a right angle thereto and toward the work axis 40, and a third section 68 extending from the second section 66 at substantially a right angle thereto and toward the plane of the workpiece. The third section 68 is located so as to be in positional alignment with the work axis 40 and so as not to extend beyond the plane containing the frame front end portion 14. Ram 60 is cast or otherwise formed of metal with the major portion thereof having a substantially constant thickness as viewed in FIG. 3 and with ram 60 having a shape wherein portions 64 and 66 are of a substantial width as seen in FIG. 6 and portion 68 is considerably smaller in width. The third section 68 has inwardly tapered sidewalls shown in FIG. 3 and terminates in the formation or upset button 62 which is in substantial alignment with the drilling and riveting axis 40.

The ram and clamp means further comprises motive means in the form of an hydraulic cyliner designated 74 in FIG. 6 carried by the frame main body portion 12 for moving the ram 60 toward and away from the workpiece. Cylinder 74 includes a housing 76 and piston rod 78. Housing 76 is mounted in the machine frame by means of a plurality of rods 80 which extend through opposite end sections 82,84 of the housing and which extend further through the top wall 22. The rods 80 are fixed at one end to top wall 22 by nuts 86 threaded on the projecting ends, and rods 80 are fixed at the opposite ends to housing section 84 by nuts 88. Hydraulic fluid is supplied to and withdrawn from opposite ends of cylinder 74 by fluid lines or conduits 90 and 92 leading from housing end sections 82 and 84, respectively, through openings in the frame end wall 20 to a remote fluid power source and control. Piston rod 78 is connected to the ram first portion 64 by means of a connecting element 96, one end of which is threaded onto the end of piston rod 78 and the other end of which is received in an opening formed in ram portion 64. A connecting pin member 98 is fitted firmly in a bore in ram portion 64 and extends through an opening in the received end of element 96. A pair of coaxial, sleeve-like coupling elements complete the connection between pin 98 and element 96.

Movement of ram 60 in the frame main body portion is guided by the following arrangement. As shown in FIGS. 3 and 6, fastened to opposite sides of ram portion 64 are a pair of ram side guides or arms 100,102 which extend into the frame in spaced, parallel relation close to frame side walls 16,18. A pair of longitudinally spaced roller bearings 104 are rotatably mounted on shafts 106 fixed in arm 100, and similarly a pair of longitudinally spaced roller bearings 108 are rotatably mounted on shafts 110 fixed to arm 102. The bearings 104,108 can be of the type commercially available under the designation McGill Camrol bearings. The bearings, in turn, are movably received in elongated openings in side walls 16,18. As shown in FIGS. 1 and 7, bearings 104 are received in corresponding openings 112 in side wall 16 which are fitted with wear strips 114 of suitable wear-resistant material. Similarly, as shown in FIGS. 6 and 7, berings 108 are received in openings 116 in wall 18 fitted with wear strips 118. The width of each opening 112,116 measured between the wear strips is substantially equal to the diameter of the received roller bearing, and the lengths of the openings 112,116 are equal and determined by the desired amount of travel of ram 60. Also, wear plates 120,122 are placed between the inner surfaces of walls 16,18 and adjacent arms 100,102. Covers 124 are fastened to the outer surfaces of walls 16,18 over the openings 112,116.

The ram and clamping means 44 further comprises clamping means movably connected to the ram 60 and located on the ram for movement therewith toward and away from the workpiece, the clamping means including means defining a clamping surface for contacting the one side of the workpiece in advance of the formation 62 on ram 60. As shown in FIG. 3, the clamping means comprises a pair of clamping arms generally designated 130,132 movably connected to opposite sides of ram 60. In particular, clamping arm 130 has a planar main body portion 134 contacting the adjacent surface of ram 60 and an upstanding leg portion 136 disposed at an angle thereto. Similarly, clamping arm 132 has a planar main body portion 138 contacting the opposite side surface of ram 60 and an upstanding leg portion 140 disposed at an angle thereto. The two leg portions 136,140 are joined by a bar 142 disposed in a plane parallel to the plane of the workpiece. The bar 142 defines the clamping surface and has an opening 144 therethrough to allow passage of the rivet heading formation 62 during relative movement between the ram and clamping arms. Clamping arms 130,132 are joined at the ends near ram portion 64 by a clamp stop bar 146 shown in FIG. 6.

Each of the clamping arms 130,132 is movably connected to the ram 60 and there is provided clamping force applying means operatively connected to the ram and clamping means 44 for applying a clamping force to the workpiece when the clamping surface is brought into contact therewith. In the arrangement shown, the clamping force applying means includes a pair of pneumatic cylinders 148,150, and thehhousing of each cylinder is fixed to ram 60 and the piston rod of each cylinder is fixed to the corresponding clamp arm. As a result, the cylinders 148,150 tend to move with ram 60 and tend to pull upwardly on the clamp arms 130,132 as viewed in FIGS. 1, 3 and 6, using the ram as an anchor point. In particular, a pair of spaced-apart tie rods 154,156 are fixed in ram 60 in spaced-apart relation in a direction generally perpendicular to drilling and riveting axis 40, and rods 154,156 extend outwardly from opposite sides of ram 60. As shown in FIG. 1, rods 154 and 156 are received in elongated slots 158 and 160, respectively in portion 134 of clamp arm 130, and the ends of rods 154 and 156 are fastened in brackets 162 and 164, respectively. Brackets 162,164 are fixed to a mounting plate 166 by screws 167,168. The housing of cylinder 148 rests on plate 166 between brackets 162,164, the piston rod 170 thereof extends through an opening in plate 166, and the cylinder housing is fixed to plate 166 by means of nut 172. Piston rod 170 is connected to a clevis block 174 by a clevis pin 176, and block 174 is fixed to clamp arm 130 by screws 178. In a similar manner, and referring to FIG. 6, rods 154 and 156 are also received in elongated slots 180 and 182, respectively, in portion 138 of clamp arm 132 and the ends of rods 154 and 156 are fastened in brackets 184 and 186, respectively, which brackets are fixed to a mounting plate 188 by screws 190 shown in FIG. 3. The housing of cylinder 150 rests on mounting plate 188 between the brackets, the piston rod 192 thereof extends through an opening in plate 188 and the cylinder housing is fixed to plate 188 by means of nut 194. Piston rod 192 is connected to a clevis block 196 by a clevis pin, and block 196 is fixed to clamp arm 132 by screws 198 as shown in FIG. 3.

Air is supplied to cylinders 148,150 on the side of each piston facing mounting plates 166,188 as viewed in FIGS. 1, 3 and 6 and each cylinder is vented to the atmosphere on the opposite side of the piston. Substantially constant pressure is supplied to cylinders 148,150 during operation of the machine, for example about 200 psi in each cylinder. When ram 60 is moved toward the workpiece, clamp arms 130,132 are carried with it and when the surface of bar 142 contacts the workpiece the pressure in cylinders 148,150 provides a clamping force. During upsetting of the rivet, when ram 60 is moved relative to clamp arms 130,132 further toward the workpiece to force button 62 against the rivet in a manner which will be described, the relative movement between ram 60 and clamp arms 130,132 tends to compress the air in cylinders 148,150.

A position sensor generally designated 200 in FIG. 1 signals when ram 60 reaches the position where bar 142 carried by clamp arms 130,132 contacts the lower surface of the workpiece to clamp the same in a manner which will be described in further detail presently. Sensor 200 includes a sensor stop bar 202 fastened to mounting plate 166 by screw 204. Bar 202 thus is carried by arm 60 during movement relative to clamp arms 130,132. Bar 202 includes an internal fluid port (not shown) which is connected to a line or conduit (not shown) included in a fluid logic circuit. The portion of sensor 200 fixed to clamp arm 130 includes a sensing rod 206 connected to arm 130 by a bracket 208 and having a collar 210 fixed thereto. A compression spring 212 is located on rod 206 between bracket 208 and bar 202. The end of rod 206 has a formation which is movably received in an opening in bar 202 in communication with the interior port. When ram 60 and clamp arms 130,132 reach the position where bar 142 contacts the workpiece during clamping as shown in FIG. 1, the formation on the end of rod 206 is in a position closing the port in bar 202 thereby providing a fluid pressure signal of one state to the logic network. When ram 60 is in any other position relative to arms 130,132 the formation on the end of rod 206 is away from the port in bar 202 thereby opening it to provide a different fluid pressure signal of another state to the fluid logic network, Another sensor generally designated 220 in FIGS. 1 and 22 is carried by clamp arm 130 for signalling the location of arm 130, for example when the ram 60 and clamp arms 130,132 are in a partial downward position after riveting to clear the upset rivet head when the machine is moved to the next drilling and riveting location. Sensor 200 is similar in construction to sensor 200, being mounted on arm 130 and having a sensing rod which is movable between opening and closing positions relative to a fluid port of a fixed component mounted on the machine frame.

The machine 10 of the present invention further comprises drilling means generally designated 240 carried by the frame main body portion 12 for drilling a rivet-receiving hole in the workpiece. Drilling means 240 has a longitudinal axis coincident with the axis of rotation of the drill therein, and the drilling means 240 has a rest position in the frame main body portion 12 wherein the longitudinal axis of the drilling means 240 is disposed substantially perpendicular to the plane of the workpiece. During operation of the machine 10, drilling means 240 is moved from the rest position to a position where the longitudinal axis of drilling means 240 is substantially coincident with the drilling and riveting axis 40, for example as shown in FIGS. 1 and 3, then is moved toward and away from the workpiece for drilling the same, whereupon the drilling means 240 is returned to the rest position thereof in a manner which will be described. Drilling means 240 includes a housing generally designated 242 containing a drill spindle, a gear housing designated 244 and a drill motor 246.

Figure 8:
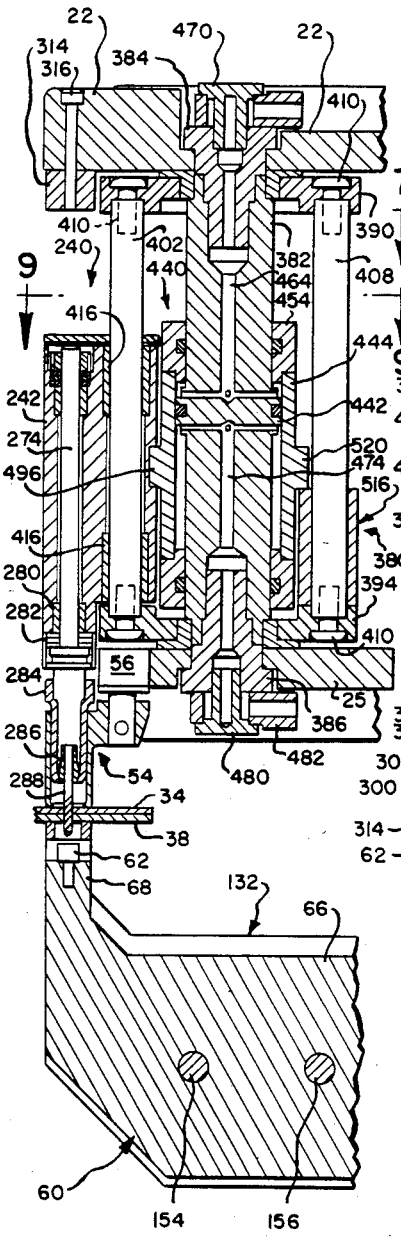
FIG. 8 is a fragmentary longitudinal sectional view similar to a portion of FIG. 6 and showing parts of the machine in positions corresponding to a drilling mode of operation.
Figure 12:
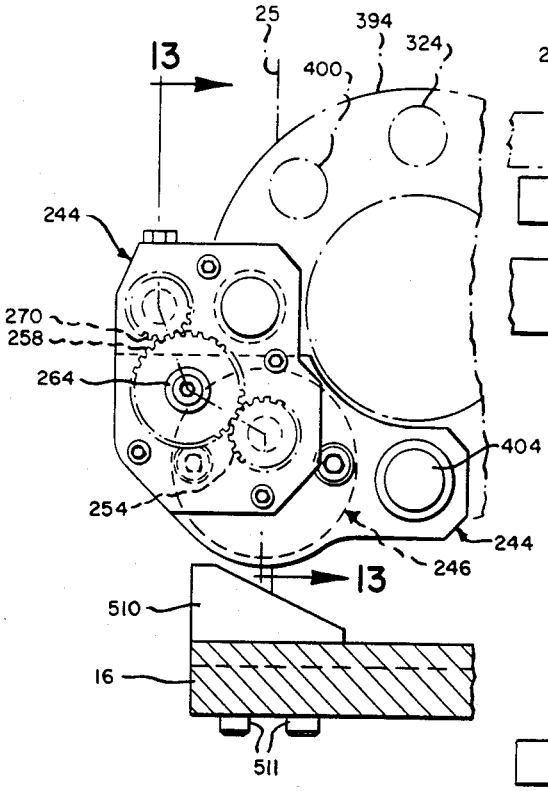
FIG. 12 is a fragmentary plan view of the drilling means of the machine.
Figure 13:
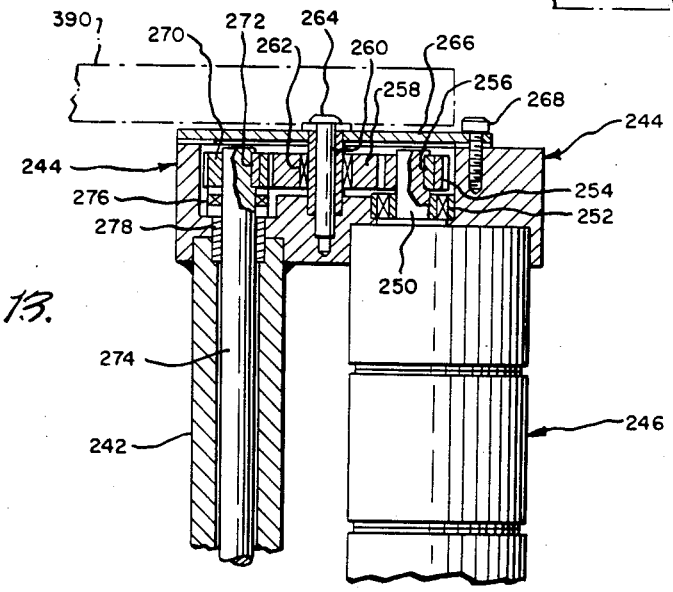
FIG. 13 is a fragmentary sectional view taken about on line 13—13 of FIG. 12.

Referring now in detail to FIGS. 12 and 13, the drill motor 246 is of the hydraulic type, small in size and high in torque, and hydraulic fluid is supplied to and withdrawn from motor 246 in a conventional manner by means of lines (not shown) adjacent the lower portion of motor 246 as viewed in FIG. 13. Motor 246 has an output shaft 250 journaled in housing 244 by means of a ball bearing 252 and the outer end of shaft 250 is provided with a drive gear 254 mounted thereon by means of a key 256. An idler gear 258 meshes with drive gear 254, and the gear 258 is journaled to an idler shaft or sleeve 260 by means of a bearing 262. Shaft 260, in turn, is connected to housing 244 by means of a screw 264, the head of which engages the outer surface of a cover 266 shown in FIG. 13 fastened to housing 244 by a screw 268. Idler gear 258 is in meshing relation with a driven gear 270 which is fixed by means of a key 272 to one end of a drill spindle 274. A thrust bearing 276 is on spindle 272 between driven gear 270 and an inner surface of housing 244, and the end portion of spindle 274 adjacent driven gear 270 is journaled in the housing 244 and spindle housing 242 by means of a roller bearing 278. As shown in FIG. 8, spindle 274 extends through another roller bearing 280 and a thrust bearing 282 adjacent the opposite end of spindle housing 242, and spindle 274 terminates in a collet nut 284 and a collet 286 which hold a drill bit 288 at the end of spindle 274. In the exemplary drill and motion transmission arrangement of FIGS. 12 and 13, the gear ratio is 1:1.

The machine 10 of the present invention further comprises rivet inserting and forming means generally designated 300 in FIGS. 3 and 6 carried by the frame main body portion 12 for inserting a rivet in a hole drilled in the workpiece and forming a head on the inserted rivet in cooperation with the holding and force applying means, i.e. in cooperation with the ram and clamp assembly 44. The rivet inserting and forming means 300 has a rest position in the frame main body portion 12 and has a longitudinal axis disposed substantially perpendicular to the plane of the workpiece being drilled and riveted. During operation of machine 10, after a hole is drilled in the workpiece, the rivet inserting and forming means 300 is moved from that rest position to a position where the longitudinal axis of the rivet inserting and forming means is substantially coincident with the drilling and riveting axis 40. Then the rivet inserting and forming means 300 is moved toward the workpiece for inserting a rivet in the workpiece hole provided by the drilling means 240 and for heading the rivet in cooperation with the ram and clamp assembly 44, whereupon the rivet inserting and forming means 300 is moved away from the workpiece and then is returned to the rest position in a manner which will be described. The rivet inserting and forming means 300 includes, briefly, means in the form of rivet grasping fingers 302 for holding a rivet and moving it into an inserted position in a hole drilled in the workpiece and the fingers 302 are operatively associated with means including an anvil 304 for transmitting force applied to the rivet by ram 60 during heading thereof, the force ultimately being transmittedtto the machine frame in a manner which now will be described.

Anvil 304 is fixed at one end in an anvil holder member generally designated 306 in FIGS. 3 and 6. Anvil 304 is in the form of a rod, and is fitted in the end of holder 306 and fastened therein by a screw 308 as shown in FIG. 3. Fingers 302 are pivotally connected at the upper ends thereof to a finger holder 309 which is axially slideable along the lower end portion of anvil 304, and a biasing spring 310 is on anvil 304 between finger holder 309 and anvil holder 306. Spring 310 normally urges fingers 302 into an extended position beyond the end of anvil 304 enabling them to receive and hold a rivet therebetween. When the inserting and forming means 300 is moved along work axis 40 toward the workpiece, as rivet which is held by finters 302 spaced from the end of anvil 304 is inserted in the hole in the workpiece the finger holder 309 contacts the upper edge of pressure foot 54 and as the means 300 is moves further toward the workpiece the fingers 302 are pivoted outwardly a small distance whereupon the position shown in FIG. 6 is reached where the end of anvil 304 contacts the head of the rivet 314 and the fingers 302 have been moved to a position where after forming the rivet and movement of the means 300 away from the workpiece the fingers 302 will release the rivet. At that time when holder 309 is moved away from pressure foot 54, spring 301 returns fingers 302 to their initial position.

During heading of the rivet, force is transmitted to the machine frame by the following means. In this mode of operation, anvil 304 is in position with the longitudinal axis thereof in alignment with the drilling and riveting axis 40 and anvil 304 transmits force to anvil holder 306 which has a substantial portion of the body thereof in alignment with axis 40. Holder 306, in turn, transmits force toward the frame through another force transmitting member in the form of a buck spacer designated 312 in FIG. 6. The force transmitting member or buck spacer 31 is carried by the frame main body portion 12 for movement from a rest position as shown in FIG. 10 to a force transmitting or operative position as shown in FIG. 6 wherein the buck spacer 312 is in force transmitting engagement with anvil holder 306 and the machine frame. When spacer 312 is in operative position, it transmits rivet heading force from anvil holder 306 to the frame through a buck support bar 314 fastened to the inner surface of frame top wall 22 by suitable means, such as screw 316 as shown in FIG. 6. Buck support bar 312 is substantially solid cylindrical in shape, and in the force transmitting position has the longitudinal axis thereof in substantial alignment with the work axis 40, one axial end face contacting an end face of anvil holder 306 and the opposite end in force-transmitting contact with bar 314. Force is distributed through top wall 22 and along frame sidewalls 16,18 and frame end wall 20.

Figure 4:
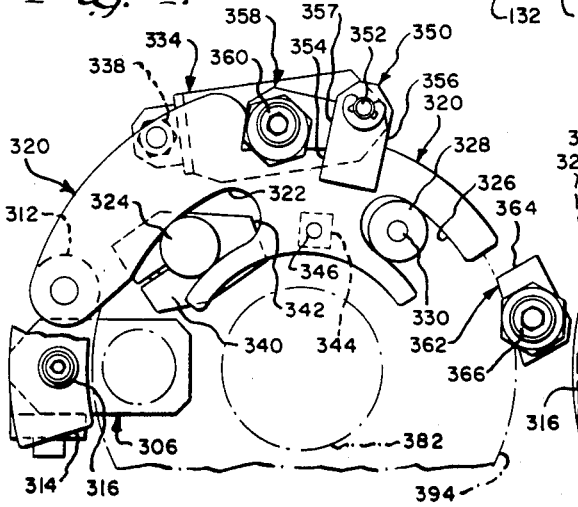
FIG. 4 is a plan view with parts removed and partially diagrammatic taken from below the top frame member in FIG. 3 part and showing the various components in one operational position.
Figure 5:
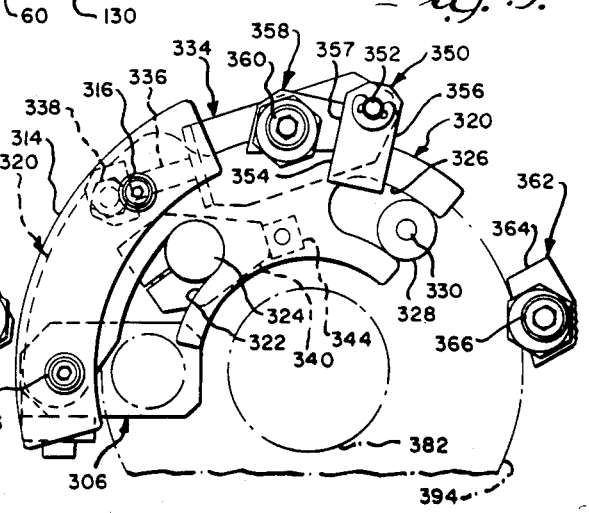
FIG. 5 is a view similar to FIG. 4 but with the parts thereof in a different operation position.

The buck spacer member 312 is moved between rest and operative positions in the following manner. Referring now to FIGS. 4 and 5 buck spacer 312 is fixed at one end to a bucking arm 320 as shown in FIG. 4 which illustrates buck spacer 312 in a rest position. Arm 320 is generally arcuate in overall shape and has a first recess 322 associated with an edge of arm 320 near the connection to buck spacer 312. A rod 324 disposed generally parallel to the drilling and riveting axis 40 extends through the recess 322 as shown in FIG. 4 for guiding movement of arm 320 along a plane generally perpendicular to the drilling and riveting axis 40. Rod 324 is fixed at opposite ends to other components of the machine in a manner which will be described. Arm 320 is provided with a second recess 326 extending inwardly from the other end thereof as shown in FIG. 4. A roller 328 or cam follower-type element is received in recess 326 and is rotatably connected to a shaft 330 fixed to structure in machine 10 stationary relative to arm 320 in a manner which will be described. Thus, roller 328 in cooperation with recess 326 and rod 324 in cooperation with recess 322 guide movement of arm 320.

Arm 320 is shown in FIG. 4 in a position where buck spacer 312 is out of longitudinal alignment with anvil holder 306. This is similar to the position shown also in FIG. 10. Buck spacer 312 is moved into a position as shown in FIGS. 5 and 6 in longitudinal alignment with anvil holder 306 by motive means in the form of a pneumatic cylinder 334 having a housing fixed to a structure in machine 10 stationary relative to arm 320 in a manner which will be described. Air is supplied to and withdrawn from cylinder 334 in a conventional manner by lines or conduits (not shown) connected thereto. Cylinder 334 has a piston rod 336 connected to arm 320 by a clevis pin and retainer designated 338. Thus, when piston rod 336 is retracted buck spacer 312 is in the position shown in FIG. 4, and when cylinder 334 is operated to extend rod 336, arm 320 is moved to the position of FIG. 5 thereby placing buck spacer 312 in longitudinal alignment with anvil holder 306, movement of arm 320 being guided by the rod 324 and roller 328 as previously described.

There is provided means for sensing the two positions of arm 320 as shown in FIGS. 4 and 5, and, therefore, the rest and operative positions of buck spacer 312. A block member 340 is fastened to rod 324 and has a surface 342 including a port connected to the machine fluid logic network. A plug 344 is fixed to arm 320 by a screw 346. In the position illustrated in FIG. 4, the port on block member 340 is opened thereby providing a first state pressure signal to the fluid logic network. In the position of the components shown in FIG. 5, plug 334 is moved into position contacting surface 343 of member 340 in a manner blocking the port. As a result, a second state fluid pressure signal is provided to the logic network.

FIGS. 4 and 5 also illustrate means for sensing the two positions of the rivet inserting and forming means 300. In FIGS. 4 and 5 the rivet inserting and forming means 300 is in an operative position in alignment with the drilling and riveting axis 40 as shown also in FIG. 6. As previously described, the rivet inserting and forming means 300 is movable between rest and operative positions, this being accomplished by means to be described. The sensing means comprises a key element 350 fixed to the housing of pneumatic cylinder 334 by a clevis pin 352. This same pin 352 can anchor the cylinder to components of the machine previously described. Key element 350 thus moves with the rivet inserting and forming means 340 between the rest and operative positions. Key 350 has oppositely directed surface portions 354,356 and is shown in FIGS. 4 and 5 with surface 354 contacting the ported surface 357 of a stop key member 358 which is fastened to the frame top wall 22 by a screw 360. The port is connected by a line (not shown) to the aforementioned fluid logic network, and closing of the port signals the logic network that the rivet inserting and forming means 300 is in the operative position in alignment with the work axis 40. Another stop key member 362 having a ported surface 364 is located in spaced relation to key element 350 and is fixed to frame top wall 22 by a screw 66. Location of stop key 362 corresponds to the rest position of the rivet inserting and forming means 300. When the means 300 is in the rest position surface, 356 of key element 350 contacts surface 364 of stop key 362 to close the port thereof thereby signalling the fluid logic network that the rivet inserting and forming means 300 is in the rest position.

Machine 10 of the present invention further comprises transfer means generally designated 380 in FIGS. 6 and 8 carried by the frame main body portion 12 and operatively associated with the drilling means 240 and operatively associated with the rivet inserting and forming means 300 for selectively moving each of the drilling means and the rivet inserting and forming means into and out of positional alignment with the drilling and riveting axis 40 and for moving each toward and away from the workpiece. The transfer means 380 comprises an assembly having a longitudinal axis substantially parallel to the drilling and riveting axis 40 and the assembly is mounted in the frame main body portion for movement about that longitudinal axis in a manner which will be described. The assembly comprises a central shaft member 382 disposed with the longitudinal axis thereof substantially parallel to the drilling and riveting axis 40. One end of shaft 382 is fixed to frame top wall 22 by means of a shoulder bolt 384, and the opposite end of shaft 382 is fixed to frame bottom wall 24 by another shoulder bolt 386. The assembly further comprises a pair of end members rotatably mounted on shaft 382 adjacent opposite ends thereof. In particular, a top plate element 390 which is generally disc-shaped is rotatably mounted on the upper end of shaft 382 as viewed in FIGS. 6 and 8 by means of a annular bearing 392 received in a central aperture of plate 390 and fitted in a shoulder formed on the end portion of shaft 382 adjacent the inner surface of top wall 22. Similarly, a bottom plate 394, identical to top plate 390, is generally disc-shaped and is rotatably mounted on the lower end of shaft 382 by means of an annular bearing 396 received in a central aperture of plate 394 and fitted in an annular shoulder on the end of shaft 382 adjacent the inner surface of bottom wall 24.

The end members 390 and 394 are held in position in the assembly by a plurality of tie rods, in the present illustration five tie rods 400, 402, 404, 406 and 408 which together with the previously described rod 324 are spaced circumferentially about and radially outwardly of shaft 382 as shown also in FIGS. 7 and 9. The rods are fixed at opposite ends thereof to the end members 390, 394 by suitable fastening means such as screws 410. The tie rods also serve to mount the drilling means 240 and the rivet inserting and forming means 300 in the assembly for bi-directional movement substantially parallel to the longitudinal axis of the assembly, i.e. substantially parallel to the axis of shaft 382, which bi-directional movement is toward and away from a workpiece to be drilled and riveted. In particuler, tie rods 402 and 402 extend through longitudinal bores provided in the drill spindle housing and an extension of the drill motor housing, movement being faciliated by axially spaced sleeve bearings, for example those designated 416 in FIG. 8. Similarly, tie rod 400 and rod 324 extend through longitudinal bores in anvil holder 306 with movement being facilitated by sleeve bearings 416 shown in FIG. 6.

The transfer means further comprises means for moving the assembly in opposite directions about the longitudinal axis thereof, i.e. about the axis of shaft 382, so as to move each of the drilling means 240 and the rivet inserting and forming means 300 into and out of positional alignment with the machine drilling and riveting axis 40. As shown in FIG. 9, an arcuate gear segment 424 is fixed to end member 394, in particular to the inner surface thereof which faces the opposite end member 390, and segment 424 is located between shaft 382 and the peripheral edge of end member 394, being located with the teeth thereof spaced a short distance inwardly of the peripheral edge. Gear segment 424 has an arc length of about 45 degrees. Gear segment 424 is in meshing relation with another gear segment 428 fixed to the output shaft 430 of a rotary actuator generally designated 432 in the form of an hydraulic motor. Gear segment 428 is in the form of a quadrant of a circle. Motor 432 is mounted to frame bottom plate 24 in a suitable manner, and a pair of fluid lines (not shown) conduct hydraulic fluid to and from motor 432 for operating the same. Motor 432 is of the type wherein the direction of rotation of shaft 430 is determined by the direction of flow of hydraulic fluid therethrough. One motor found to perform satisfactorily is available commercially from Roto Actuator Corp. under the designation Torq-Mor rotary actuator.

The transfer means further comprises means for moving the drilling means 240 and the rivet and inserting forming means 300 selectively in opposite directions substantially parallel to the longitudinal axis of the assembly, i.e. the axis of shaft 382, thereby moving them toward and away from the workpiece for drilling and for rivet inserting and forming. The moving means generally designated 440 is located inwardly of the drilling means 240 and inwardly of the rivet inserting and forming means 300, is operatively associated with the longitudinal axis of the assembly, i.e. the axis of shaft 382, and is movable in opposite directions along and axis and substantially parallel to the axis of shaft 382. There is also provided means for selectively engaging the drilling means 240 and the rivet inserting and forming means 300 for carrying either therewith.

Referring now to FIGS. 6 and 8, shaft 382 is of constant outer diameter along a major portion of the axial length thereof, and shaft 382 has an annular enlarged portion 442 of relatively short axial length and located substantially midway between the axial ends of shaft 382. A sleeve 442 is mounted on shaft 382 for axial movement therealong. The inner diameter of sleeve 444 is substantially equal to the outer diameter of the shaft enlarged portion 442. An annular seal element 446 is seated in an annular groove provided in the outer surface of enlargement 442 for providing sealing contact with the inner surface of sleeve 444. Thus, sleeve 444 and shaft 382 cooperate to define axially spaced annular chambers 448 and 450. The chambers are closed at the inner axial ends by the shaft enlargement 442. Chamber 448 is closed at the other end, i.e. the top end as viewed in FIGS. 6 and 8, by an end cap member 454 which is fixed to the axial end of sleeve 444. Cap member 454 ispprovided with a seal ring 456 seated in an annular groove provided in the inner annular surface thereof. Seal 456 provides sealing contact with the surface of shaft 382. Similarly, chamber 450 is closed at the inner end by shaft enlargement 442 and is closed at the other end, i.e. the lower end of the assembly as viewed in FIGS. 6 and 8, by an end cap member 458 fixed to the axial end of sleeve 444. End cap 458 provided with an inner seal ring 460 seated in an annular groove in the inner surface of cap 458 for providing sealing contact with the surface of shaft 382.

Sleeve 442 is shown in FIGS. 6 and 8 in a position at the end of the travel thereof along shaft 382 toward the end member 458 where annular chamber 450 is of maximum volume and wherein chamber 448 is of minimum volume. When sleeve 444 is moved axially along shaft 382 toward end member 454, the annular chamber 448 increases in volume and the chamber 450 decreases in volume.

Thus, sealed axially spaced chambers 448,450 are defined between sleeve 444 and shaft 382, and there is also provided means for selectively introducing hydraulic fluid from one of the chambers while withdrawing fluid from the other of the chambers. In particular shaft 382 is provided with a first axial bore 464 which terminates adjacent the enlargement 442 and meets a plurality of radially outwardly extending bores 466 which are in fluid communication with the chamber 448. Shoulder bolt 384 has a longitudinal bore 468 which is in fluid communication with shaft bore 464. A fitting 470 and connector element 472 are installed in the end of sahft bolt 384 for connection to a line or conduit (not shown) for supplying and withdrawing hydraulic fluid. Similarly, shaft 382 has another longitudinal bore 474 which terminates adjacent enlargement 442 and meets a plurality of radially extending bores 476 which are in fluid communication with chamber 450. Shoulder bolt 386 is provided with a central bore 478 which is in fluid communication with the shaft bore 474. A fitting 480 and connector 482 are installed in shoulder bolt 386 for connection to a line or conduit (not shown) for supplying and withdrawing hydraulic fluid. Thus, moving means 440 is moved along shaft 382 in a direction depending upon which of the chambers 448,450 hydraulic fluid is supplied to and withdrawn from.

Accordingly, the assembly of top and bottom plates 390 and 394, rod 324 and rods 400, 402, 404, 406 and 408 together with drilling means 240 and rivet inserting and forming means 300 is moved in opposite directions about shaft 382 as determined by the direction of output rotation of rotary actuator 432. The amount of movement is through an angle of about 45 degrees between the positions where drilling means 240 and rivet inserting and forming means 300 alternatively are in positional alignment with the drilling and riveting axis 40. The foregoing arrangement together with the adjustable stop keys 358,362 and the location of the axes of drill spindle 274 and anvil 304 on transfer means 380 determines the location of drilling and riveting axis 40. During the foregoing rotational movement in opposite directions, rotation of sleeve 444 relative to the foregoing assembly is prevented by means of an anti-rotation arm designated 490 in FIG. 9 which is fixed at one end thereof to frame sidewall 18 and which is disposed in a plane substantially perpendicular to the axis of shaft 382. The other end of arm 490 is provided with a notch 492 which receives a key element 494 fixed to sleeve 444 and extending radially outwardly therefrom. Key 494 is elongated, extending along the outer surface of sleeve 444 parallel to the axis thereof and for a distance such that it remains in engagement with notch 392 of arm 390 during longitudinal movement of sleeve 444.

When either drilling means 240 or rivet inserting and forming means 300 is moved into positional alignment with work axis 40, it then is moved toward and away from the workpiece in response to movement of sleeve 444 along shaft 382. In particular, another key element 496 shown in FIGS. 7 and 9 is fixed on sleeve 444 for selectively engaging the drilling means 240 or the rivet inserting and forming means 300, depending upon which has been moved into positional alignment with work axis 40, for carrying either with the sleeve 444. Thus, as shown in FIG. 9, operation of rotary actuator 432 has moved drilling means 240 into positional alignment with work axis 40 and key element 496 engages the drill housing, for example key 496 can engage a notch formed in the drill gear housing 244. Drill 240 will be moved toward or away from the workpiece as sleeve 444 moves along shaft 382 in a direction depending upon the mode of supply and withdrawl of hydraulic fluid to chambers 448,450. During this phase of theooperation, rivet inserting and forming means 300 is out of engagement from key element 496, and is supported by resting on the end of an anvil retaining shoe 500 fixed to frame bottom plate 25 by screws 501. In particular, and as shown also in FIG. 10, an arm member 502 is fixed to anvil holder 306 and extends therefrom so as to rest on the upper surface of retaining shoe 500. The location of arm 502 on anvil holder 306 is such that when holder 306 is in the full up position illustrated in FIG. 10, the lower surface of arm 502 rests on the upper surface of shoe 500 when the rivet inserting and forming means 300 is moved to the rest position. As shown also in FIG. 10, arm 502 is provided with a sensor for indicating when anvil holder 306 is in the full down position. In particular, arm 502 has a fitting 504 for connection to a line (not shown) to the fluid logic network. A port within arm 502 in communication with fitting 504 is opened and closed by a spring-biased operation member 506 which contacts the upper surface of a plate 394 when anvil holder reaches the full down position and opens or closes the port depending upon the logic mode selected.

As shown in FIG. 9, when operation of rotary actuator 432 has moved rivet inserting and forming means 300 into positional alignment with work axis 40, key element 496 engages a notch in anvil holder 306 and the anvil 304 and holder 306 will be moved toward and away from the workpiece as sleeve 444 moves along shaft 382 in a direction depending upon the mode of supply and withdrawl of hydraulic fluid to chambers 448,450. During this phase of the operation, drilling means 240 is out of engagement with key element 496, and is supported by resting on a drill retaining shoe 510 fixed to frame side wall 16 by screws 511.

During the foregoing operation, when drill 240 is in alignment with work axis 40 and is moved toward the workpiece by cylinder 444, the extent of travel of drill 240 toward the workpiece is controlled in the following manner. As shown in FIGS. 8 and 9 a drill stop member or block 516 is supported on tie rods 406,408, normally rests on the surface of bottom plate 394 and has an operative surface 518 which faces toward top plate 392. A key element 520 fixed to sleeve 444 engages surface 518 of block 516 to limit further travel of drilling means 240 in a direction toward the workpiece as shown in FIG. 8. Thus, when drilling means 240 is in positional alignment with work axis 40, key element 520 is in alignment with stop member 516, and when drill 240 is in the rest position as illustrated in FIG. 7, stop member 516 is moved out of alignment with key element 520.

Figure 14:
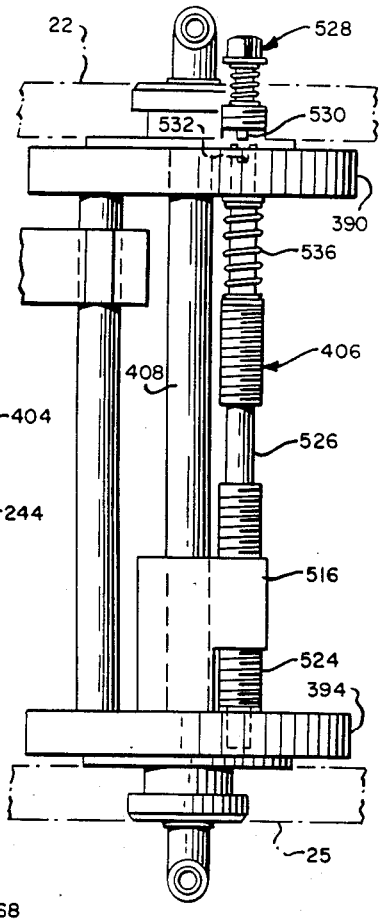
FIG. 14 is a fragmentary elevational view illustrating the adjustable stop for the drilling means of the machine.

The location at which key element 520 engages stop member 516 is adjustable enabling adjustment of the point at which descent of drill 240 is stopped. This is of particular use in controlling the depth of countersink in the workpiece. Stop member 516 is slidably movable along one of the tie rods, for example rod 408, and is threaded on the other tie rod 406. As shown in FIG. 14, tie rod 406 has a threaded portion 524 fixed on a central rod 526 and threaded in member 516. Rod 526 is rotatably connected at opposite ends in top and bottom plates 392,394 of the transfer assembly. Adjacent the upper end of rod 526 as viewed in FIG. 14, a spring-biased adjustment screw 528 extends through frame top plate 22 and has a tab 530 on the end thereof for engagement in a notch 532 on the end of rod 526. When it is desired to adjust the height of member 516 as viewed in FIG. 14, screw 528 is depressed against the face of the biasing spring to engage tab 530 in notch 532 whereupon screw 528 is turned to rotate rod 526 and threaded section 524 to raise or lower member 516 to the desired position. Another spring 536 on rod 526 engages top plate 392 and a section of the rod 526 to hold the assembly in the adjusted position when screw 528 is released.

The pressure foot bushing 54 is shown in further detail in FIG. 11. It is moved toward and away from the workpiece by a pneumatic cylinder 56 fixed to frame bottom wall 25 and having a piston rod element 540 connected to the body of bushing 54. Bushing 54 has a hollow body portion 542 shaped and dimensioned to receive the collet nut 284, collet 286 and drill bit 288 during the drilling mode as shown in FIG. 8 and to receive the lower end of anvil 304 and the finger 302 during the rivet inserting and forming mode as shown in FIG. 6. Body 542 has a planar end face 544 provided with an opening 546 to allow passage therethrough of the drill bit 288 and rivet blank 314 in the foregoing modes. Bushing 54 has associated therewith a line 548 having a fitting 550 at one end for connection to a supply line (not shown) from a source of high pressure air and terminating at the opposite end in a nozzle-like formation directed toward opening 546 for blowing away metal chips in a conventional manner during drilling of the workpiece. Line 548 can be a flexible metal tube to permit adjustment of the angle and direction of the air jet leaving the nozzle end or, alternatively, line 548 can be provided by a passage formed in the body of bushing 54.

The machine 10 of the present invention further comprises means carried by the frame for maintaining rivets in a predetermined orientation as they are injected or fed to fingers 302 of the rivet inserting and forming means 300. An injector housing generally designated 560 is mounted to the lower surface of frame bottom wall 25 as viewed in FIG. 16, the mounting being by suitable means such as screws designated 562 in FIG. 15. Housing 560 has a portion 564 located outwardly beyond wall 25 which includes a surface 566 provided with a formation for receiving a rivet blank and guiding it during injection or placement into fingers 302 in a manner which will be described. The rivet blanks are stored in a hopper or similar device (not shown) in a conventional manner and are passed individually along a feed tube 568 leading from the hopper and connected at the end thereof through a barrel element 570 to housing portion 564 to place the rivet blanks in the receiving and guiding formation. Rivet blanks can travel along tube 568 by the force of gravity when the machine 10 is so oriented and located relative to the hopper, or the rivet blank can be forced along tube 568 by air pressure in which case the machine can have any orientation or location. In particular, individual rivets travel along tube 568 with the shank end leading and head end trailing and are guided by barrel element 570 whereupon the rivet lands with the shank extending through opening 572 shown in FIG. 15 and with the head thereof being supported by the edge formation surrounding opening 572 which will be described. A slot extends from opening 572 in a manner defining spaced, parallel ledges 574,576 in a direction toward the rivet-receiving location of fingers 302. Edges 574,576 are spaced a distance to allow the rivet shank to pass through and yet engage the rivet head in a supporting manner.

Figure 15:
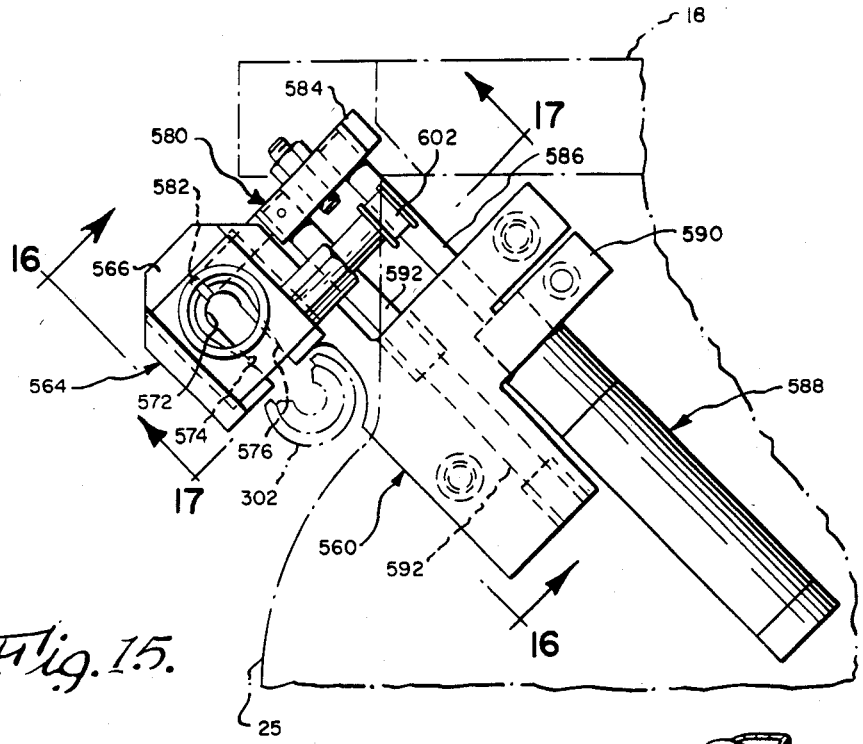
FIG. 15 is a fragmentary plan view taken about on line 15—15 in FIG. 3 and illustrating the rivet injector means of the machine according to the present invention.
Figure 17:
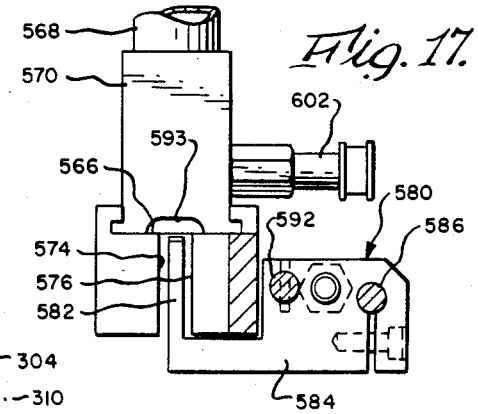
FIG. 17 is an elevational view taken about on line 17—17 in FIG. 15.
Figure 16:
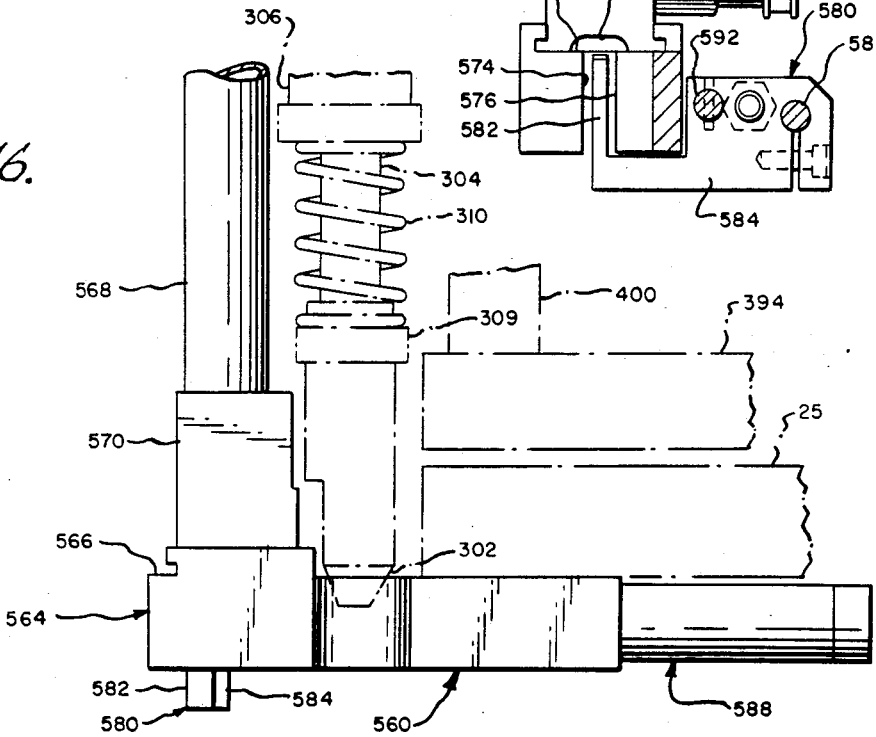
FIG. 16 is a fragmentary elevational view taken about on line 16—16 in FIG. 15.

A rivet blank held in opening 572 by the surrounding edge formation is moved into engagement with fingers 302 by means including an arm generally designated 580 having a blade-like portion 582 and a main body portion 584. Body portion 584, in turn, is connected to the rod 586 of a pneumatic cylinder 588 carried by housing 560, the cylinder housing being held in a clamp-like bracket 590 formed as an integral part of housing 560. As shown in FIGS. 15 and 17, rod 586 is connected to body portion 584 near the outer end thereof, and movement of rod 586 and arm 580 is guided by a guide rod 592 connected at one end to body portion 584, extending generally parallel to the axis of cylinder rod 586, and slidably received in housing 560. When a rivet is to be moved toward fingers 302, cylinder 588 is operated to retract rod 586 which moves blade 584 into contact with the rivet and in a direction along ledges 574,576 whereupon the rivet is placed in fingers 302. A passage 593 in the wall of barrel 570 shown in FIG. 17 allows clearance for passage of the rivet heads therethrough. Cylinder 588 then is operated to extend rod 586 to return blade 574 to its initial position.

Figure 18:
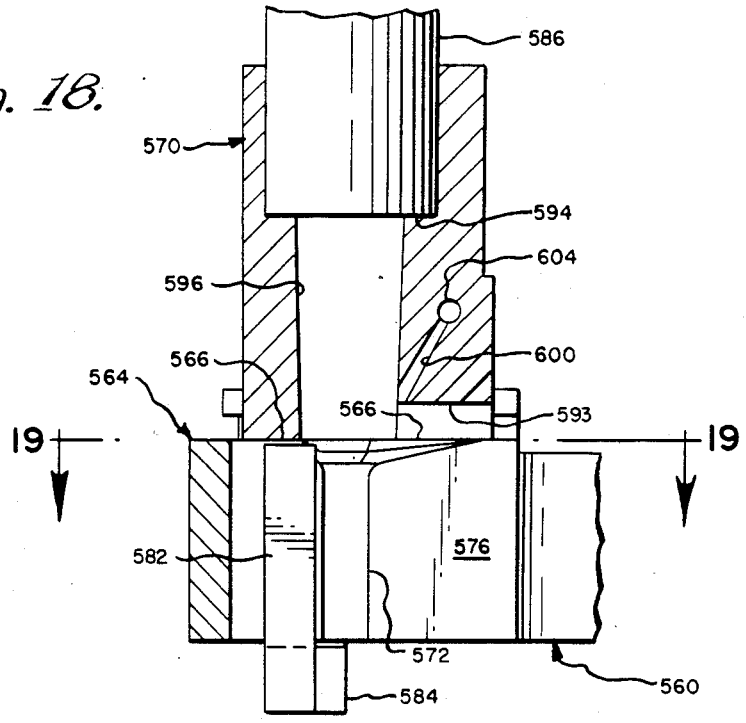
FIG. 18 is an enlarged fragmentary vertical sectional view of the rivet holding barrel of the injector of FIGS. 15–17.

The present invention provides means to receive rivet blanks from the feed conduit 568 and place them in proper orientation for subsequent injection in fingers 302 and to maintain the rivet blanks in such proper orientation prior to injection and in any orientation of machine 10. As shown in FIG. 18, the end of barrel element 570 which receives feed tube 568 is of constant inner diameter and terminates in an annular shoulder 594 which contacts the end of tube 568. A slightly inwardly tapering passage 596 extends from shoulder 594 to the opposite face of barrel 570 which rests on housing 560 adjacent the rivet landing area. The smaller end of the tapered or conveying passage 596, i.e. the exit end adjacent the landing area, is slightly larger, for example about 0.002 inch, in diameter than the head of the largest rivet used with machine 10. By way of further example, for use with 5/32 size rivets, the opposite or entrance end of passage 596 has a diameter of about 0.292 inch. The tapered surface prevents the rivet from flipping or jamming and helps keep it properly oriented for injection. In particular, the tapered passage 596 causes a spiraling, slowing effect which forces the rivet to enter the landing area associated with opening 572 without cocking. Thus, the rivet traveling along tube 568 enters barrel 570 and is funneled and slowed by the tapered passage 596 whereupon it drops down into the landing area associated with opening 572 which is contoured to accept the rivet without jamming.

In conjunction with the tapered passage 596, there is provided an air jet passage 600 having an exit end located near the rivet landing area and being disposed to direct the jet at a particular angle relative to the landing area. In addition, the jet of air traverses the path of rivets traveling through passage 596 to the landing area. As shown in FIG. 18, the bore or passage 600 is provided in the wall of barrel 570 and opens to passage 596 near the end of barrel 570 which rests on housing surface 566. In the arrangement shown, bore 600 opens to passage 596 adjacent the clearance passage 593. The longitudinal axis of bore 600 is disposed at a predetermined angle to the plane including the rivet landing or receiving area, i.e. the plane of housing surface 566, and this angle preferably is about 65 degrees. Air pressure is supplied to passage 600 from a suitable source (not shown) connected by a line to fitting 602 which is connected to bore 600 through a supplying passage 604 in the wall of barrel 570. As a result, the single jet of air from passage 600 contacts the shank and head of a rivet dropping through passage 596 into opening 572 and the landing area therearound. Also, passage 600 is located such that the jet of air acts in a direction toward the portion of opening opposite the slot between edges 574,576. This urges the rivet into the opening 572 and keeps it straight and in line for injection. The air jet continues to act on the rivet head and tail holding it in position irregardless of gravity. As a result, the rivet can be held in opening 572 and then injected into fingers 302 while machine 10 is in any orientation or position.

Figure 19:
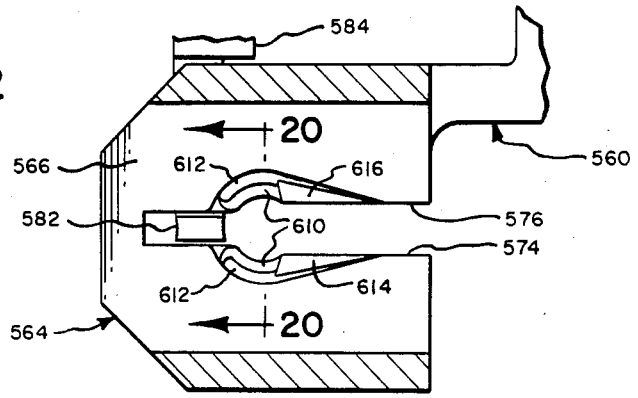
FIG. 19 is a sectional view taken about on line 19—19 in FIG. 18.
Figure 20:
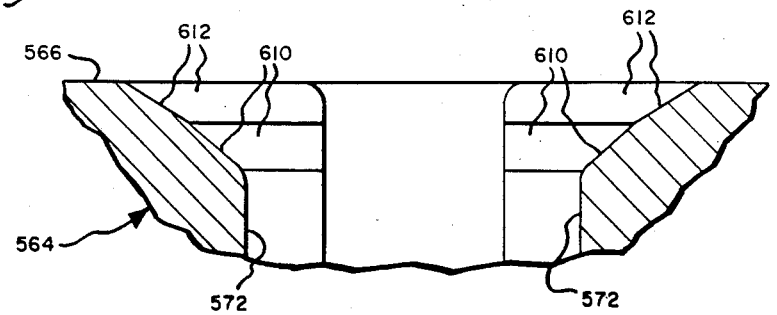
FIG. 20 is an enlarged fragmentary sectional view taken about on line 20—20 in FIG. 19.

The landing or rivet head receiving area around opening 572 is contoured to accept the rivet without allowing any tipping or jamming. The area is contoured to avoid any flat surfaces, sharp corners or other obstructions which could cause jamming. As shown in FIGS. 19 and 20, the landing area includes a first surface portion 610 leading from opening 572 at a particular inclination or disposition and a second surface portion 612 extending from portion 612 at a different inclination or disposition and meeting the housing surface 566. According to a preferred mode of the present invention, surface portion 610 defines an angle of about 50 degrees with a plane perpendicular to surface 566. In other words, the total included angle between opposite points on opening 572 measured relative to surface portion 610 is 100 degrees. Also, surface portion 612 defines an angle of about 60 degrees with a plane perpendicular to surface 566, i.e. the total included angle between opposite points on opening 572 measured relative to surface portion 612 is 120 degrees. The two surface portions 610 and 612 extend around a substantial portion of opening 572 whereupon they meet two transitional surface portions 614 and 616, which extend toward edges 574 and 576, respectively. Surface portions 614,616 are disposed so as to provide a relatively smooth transition from the included surface portions 610,612 around opening 572 to the right angle juncture between edges 574,576 and surface 566.

Figure 21:
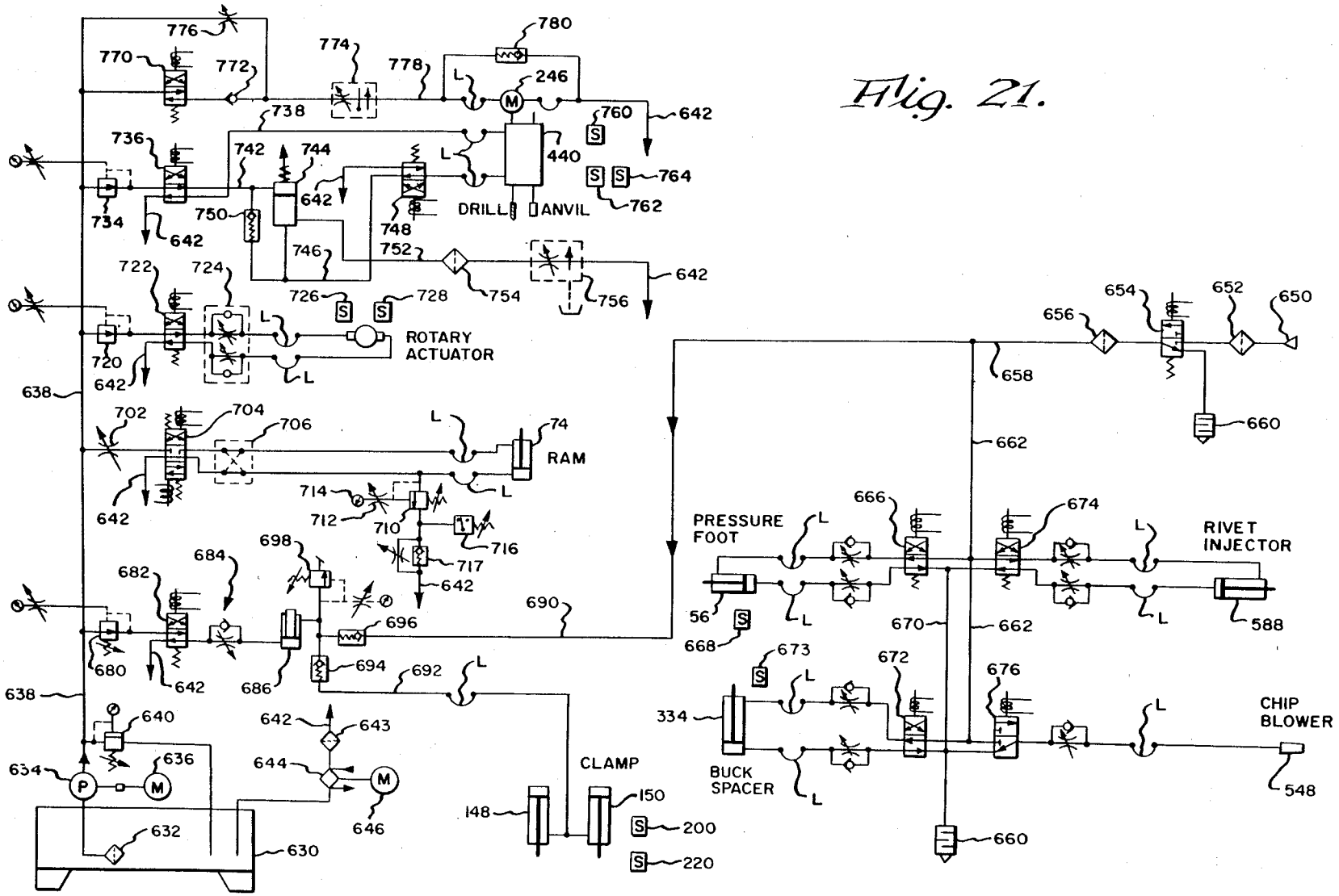
FIG. 21 is a schematic diagram of the fluid power and control circuit of the machine of the present invention.

FIG. 21 is a schematic diagram of the hydraulic and pneumatic power and control circuit for operating various components of machine 10. The sources of hydraulic and pneumatic fluid, solenoid-operated valves and other flow control components advantageously are located in spaced relation to machine 10, preferably remotely therefrom, thereby providing advantages of portability and maneuverability along with safety. Thus, the loop-like connections designated L in FIG. 21 represent fluid lines connecting components such as cylinders and motors on machine 10 with the remotely located fluid power sources and controls.

Hydraulic flud from a tank 630 is withdrawn through filter 632 by pump 634 operated by motor 636 and supplied through line 638 to various branches of the hydraulic circuit. A relief valve 640 is connected between line 638 and tank 630. Hydraulic fluid is returned from various points in the circuits connected to a main return line 642 as indicated in FIG. 21. Hydraulic fluid is returned to tank 630 through a filter 643 and a heat exchanger 644 operated by motor 646 to remove heat generated in the hydraulic fluid during operating as well as standby conditions of the circuit. The operation of motors 636 and 646 is controlled in a suitable manner by the overall system control which also can be remote from machine 10. Air under pressure, for example about 90 psi, for operating the pneumatic portion of the circuit is supplied to an inlet 650 from a suitable source and passes through a first filter 652, a solenoid-operated, three-way flow control valve 654, and a second filter 656 to a line 658 connected to various circuit branches. Valve 654 is operated under control of a main air on electrical control signal from the system control. Valve 654 also is connected to a muffler 660.

Turning first to the pneumaticpportion of the circuit of FIG. 21, there are four branches shown for operating various components of machine 10 which branches are connected by a line 662 to supply line 658. One branch is for operating the cylinder 56 which moves pressure foot bushing 54. A four-way flow control valve 666 is connected between branch supply line 662 and lines leading to the rod and piston ends of cylinder 56 in a conventional manner.

The lines adjacent valve 666 are provided with flow control components as shown. Valve 666 is operated under control of a pressure foot down electrical control signal from the system control. A sensor designated 668 signals when the pressure foot is down, this being the fluid type as previously described where closing or opening of a port signals the particular condition. Valve 666 also is connected through a line 670 to muffler 660. A second branch is for operating the cylinder 334 which moves the buck spacer 312. A four-way flow control valve 672 is connected between branch supply line 662 and lines leading to the rod and piston ends of cylinder 334 in a conventional manner. The lines adjacent valve 672 are provided with flow-control components as shown. Valve 672 is operated under control of an anvil lock or buck spacer in electrical control signal from the system control. Assensor designated 673 represents the components 342,344 shown in FIGS. 4 and 5 which provide a fluid logic signal indicating that buck spacer 312 is in position as previously described. Valve 672 also is connected to muffler 660. A third branch is for operating the cylinder 588 which moves blade 582 to inject a rivet blank into fingers 302. A four way control valve 674 is connected between branch supply line 662 and lines leading to the rod and piston ends of cylinder 588 in a conventional manner. The lines adjacent valve 674 are provided with flow control components as shown. Valve 674 is operated under control of a rivet inject electrical control signal from the system control. Valve 674 also is connected by line 670 to muffler 660. A fourth branch supplies an air blast to line 548 shown in FIG. 11 for blowing away chips from the workpiece during drilling. A three way control valve 676 is connected between branch supply line 662 and a line leading to fitting 550 on bushing 54. The line adjacent valve 676 is provided with flow control components as shown. Valve 676 is operated under control of a chip blower electrical control signal from the system control. Valve 676 also is connected to muffler 660.

Turning now to the hydraulic portion of the circuit, a first branch operates in conjunction with another pneumatic branch to operate the clamping cylinders 148,150 shown in FIGS. 1 and 3. A reducing valve 680 is connected between line 638 and a fourway control valve 682 which, in turn, is connected through a flow control 684 to the piston end of an intensifier cylinder 686 having a relatively large rod to piston area relationship. By way of example, cylinder 686 can be an Akron model BMS2. The rod end of intensifier cylinder 686 is in fluid communication with a branch line 690 leading from pneumatic supply line 658 and a line 692 leading to the rod end of each of the clamp cylinders 148,150. Check valves 694 and 696 are provided in lines 690 and 692, respectively. A relief valve 698 also is connected to the rod end of intensifier cylinder 686. Valve 682 is operated by a high clamp intensity electrical control signal from the system control. Thus, hydraulic pressure acting on the piston of intensifier cylinder 686 causes an increase in the air pressure obtained from supply line 658 to the level desired for operating clamping cylinders 148,150. The sensors 148,150 afor signalling when the ram is in the clamp and stroke positions, respectfully, as will be described.

A second branch operates the hydraulic cylinder 74 which raises and lowers ram 60. Line 638 is connected through a flow control 702 to a four way valve 704 which, in turn, is connected through a dual pilot operating check valve 706 to lines leading to the rod and piston ends of cylinder 74 in a conventional manner. Valve 704 has two solenoids and is operated by ram up and ram down electrical control signals from the system control. A relief valve 710 is connected to the line in communication with the rod end of hydraulic cylinder 74. A needle valve 712 and gage 174 are connected to valve 710. A pressure switch 716 is connected to the fluid output of valve 710. The foregoing arrangement signals the occurrence of the rivet upset operation as a function of the pressure developed by hydraulic cylinder 74. Valve 710 is set a a pressure according to the desired upset force, which depends upon the rivet being used, and when that pressure is reached, hydraulic fluid flows out to check valve 717 creating a back pressure in the line which trips switch 716 causing the ram to be returned to the stroke position.

A third branch operates the rotary actuator 432 shown in FIGS. 7 and 9. Line 638 is connected through a reducing valve 720 to a four-way flow control valve 722 which, in turn, is connected through a flow control 724 to lines leading to ports of rotary actuator 432 in a conventional manner. Valve 722 is operated by a transfer to buck electrical control signal from the system control Sensors designated 726 and 728 signal the anvil position and drill position. These correspond to the movement of key 350 between stop keys 358 and 362 described in connection with FIGS. 4 and 5.

A fourth branch controls the supply of hydraulic fluid to chamber 448,450 associated with the means 440 shown in FIGS. 6 and 8 for moving the drill and anvil toward and away from the workpiece. The branch also has a provision for slowing the speed of descent of the drill just prior to reaching the workpiece. Line 638 is connected through a reducing valve 734 to be four-way flow control valve 736. Valve 736 is connected by a line 738 to one of the chambers associated with means 440. Valve 736 also is connected by a line 742 to one end of a hydraulic dashpot 744. The other end of dashpot 744 is connected by a line 746 to a four-way flow control valve 748 which, in turn, is connected to the other chamber associated with means 440. A check valve 750 is connected across dashpot 744 as shown. The other end of dashpot 744 is connected by a line 752 through a filter 754 to a metering valve 756. Valve 736 is operated by a drill down electrical control signal from the system control, and valve 748 is operated by a feed by-pass electrical control signal from the system control.

During the drilling mode when drill 240 is moved toward the workpiece, fluid is supplied through valve 736 and line 738 to the one chamber associated with means 440 and is withdrawn from the other chamber hhrough valve 748 and line 746 through dashpot 744 and line 742 through valve 736 to the return line 642. This results in a relatively fast rate of travel of the drill toward the workpiece. Dashpot 744 is set to block further output flow through line 742 when the tip of drill bit 288 is a predetermined distance from the workpiece, for example one-eighth inch, whereupon further flow from dashpot 744 is through line 752 and metering valve 756 which is set to provide a much slower rate of travel of the drill toward and through the workpiece.

During the rivet inserting and forming mode, when anvil 304 is moved toward the workpiece, the slowed down rate of travel is not needed. Accordingly, valve 748 is operated to place the chamber associated with means 440 directly in fluid communication with return line 642. Thus, fluid is supplied to the one chamber through valve 736 and line 738 and is withdrawn from the other chamber through valve 748 to return line 642.

A first sensor 760 indicated in FIG. 21 provides a fluid logic signal when both the drill and anvil are in an up position. Sensors 762 and 764 indicate when the anvil is down and when the drill is down, respectively. By way of further illustration, sensor 762 corresponds to the sensor structure 504,506 shown in FIG. 10.

A fifth branch of the hydraulic circuit supplies hydraulic fluid to operate the drill motor 246. Line 638 is connected to a four way flow control valve 770 which, in turn, is connected through a check valve 772 to a flow control element 774. A needle valve 776 is connected across the combination of valves 770,772. Control 774 is connected by ine 778 to motor 246 and a check valve 780 is connected across the motor. Valve 770 is operated by a drill rotate electrical control signal from the system control and serves as the on-off control for the drill motor 246. Flow control element 774 controls the drill motor r.p.m.

The operation of machine 10 is best illustrated by proceeding step-by-step through an automatic drilling and riveting cycle. The start or initial condition is shown in FIG. 22 and the transfer means 380 is in the drill position with the longitudinal axis of drill spindle 274 in alignment with the drilling and riveting axis 40. The drill position also is shown in FIG. 9. This position is maintained prior to drilling and during drilling. The drill position is signalled to the fluid logic network by the pressure change caused by key element 350 closing the port on stop key 362 shown in FIGS. 4 and 5. Both the anvil 304 with related components and drill 240 are in the up position. This is signalled to the fluid logic network by the closing of a port on key element 494 by anti-rotation arm 490 shown in FIG. 9 when transfer means 440 is in the full up position. Buck spacer 312 is in the out or rest position shown in FIG. 4 and in this situation no signal is given. The assembly of ram 60 and clamp arms 130,132 is in the stroke position which, as illustrated in FIG. 22, is a partial downward position of the ram and clamp assembly after riveting to clear an upset rivet head. The stroke position is signalled by sensor 220 in the manner previously described. In order to reach this starting condition, to clear the workpiece the ram and clamp assembly can be lowered by operation of hydraulic cylinder 74 to a deep drop position which is the full downward motion of the ram and clamp assembly. No signal is given in this position. Then when the ram 60 and clamp arms 130,132 are brought up by operation of cylinder 74 to the initial condition, this is identified as the work level position which is the same as the aforementioned stroke position and which is signalled by sensor 220. In the initial or starting condition, pressure foot bushing 54 is in the up position and this is signalled to the fluid logic network in an appropriate manner.

When the system control of the machine receives all of the foregoing signals, this indicates the start condition has been achieved and the machine 10 can begin a drilling a riveting cycle. First, cylinder 56, is operated to move pressure foot bushing 54 down, i.e. toward the workpiece and this is signalled by an appropriate fluid logic sensor associated with the bushing 54 or cylinder 56. This signal, in turn, causes the control to operate hydraulic cylinder 74 to move ram 60 and clamp arms 130, 132 toward the workpiece to cause clamp. The clamp condition occurs when arms 130,132 and bar 142 move into position contacting the workpiece and clamping it to the pressure foot bushing 54.

The clamp condition is signalled by sensor 200 and this is utilized by theccontrol to signal operation of valves 736 and 770 as previously described in connection with FIG. 21 to rotate drill 240, move means 440 carrying drill 240 initially rapidly toward the workpiece, and then feed the drill slowly toward and through the workpiece due to operation of hydraulic dashpot 744 previously described. Completion of the drilling operation is signalled to the fluid logic network in an appropriate manner, for example closing of a port on the transfer assembly lower plate 394 when drill 240 is in a full down position as shown in FIG. 8 or closing of a port when key element 520 contacts surface 518 of drill stop block 516. This signal causes the system control to operate the hydraulic circuit branch in a manner moving means 440 carrying drill 240 in the opposite direction, i.e. away from the workpiece, and returning it to the full up position as shown in FIG. 22. This is signalled as previously described by thecclosing of a port on key element 494 by anti-rotation arm 490.

The foregoing signal causes the control to operate rotary actuator 432 to move or rotate transfer means 380 to the rivet position with the longitudinal axis of anvil 304 in alignment with drilling and riveting axis 40. The rivet position is illustrated, for example, in FIGS. 6, 7 and 10. This position is maintained while inserting a rivet and while riveting. The rivet position is signalled to the fluid logic network by the pressure change caused by key element 350 closing the port on stop key 358 as shown in FIGS. 4 and 5. This signal causes the control to operate valves 736 and 748 and to bypass dashpot 744 as previously described in connection with FIG. 21 to move anvil holder 306, anvil 304 and fingers 302 toward the workpiece to insert a rivet carried by fingers 302 into the hole previously drilled in the workpiece. This is illustrated in FIG. 6, and completion of the foregoing is signalled by closing a port on bottom plate 394 in a manner similar to that of the drilling mode.

Next, the control causes operation of cylinder 334 to move buck spacer 312 to the operative position between anvil holder 306 and buck support bar 314 as previously described. This is illustrated in FIGS. 4–7, and the condition is signalled by closing of the port on surface 342 by component 344 as shown in FIG. 5. This signal is utilized by the control to operate hydraulic cylinder 74 to move ram 60 further toward the workpiece causing button 62 to squeeze or upset the rivet. Upset of the rivet is signalled by the pressure increase causing operation of switch 716 described in connection with the hydraulic circuit in FIG. 21. This signal, in turn, causes hydraulic cylinder 74 to return ram 60 to the stroke position which is signalled by sensor 220.

The signal indicating return of the ram 60 to the stroke position is utilized by the control to cause operation of cylinder 334 to return buck spacer 312 to the rest position of FIG. 4. Then the control causes operation of the hydraulic circuit branch in a manner moving means 440 carrying anvil holder 306, anvil 304 and fingers 302 in the opposite direction, i.e. away from the workpiece, and returning it to the full up position as shown, for example, in FIG. 10. This is signalled as previously described by the closing of a port on key element 494 by antirotation arm 490. This signal, in turn, causes the control to operate rotary actuator 432 to move or rotate transfer means 380 to the drill position shown in FIG. 22. This is signalled by operation of key element 350 and stop key 362 as previously described. Cylinder 56 then is operated to move pressure foot bushing 54 away from the workpiece. Finally, injector cylinder 588 is operated to transfer a rivet blank from the holding area to the fingers 302 to prepare the machine for the next drilling and riveting cycle.

Thus, there is provided an automatic drilling and riveting machine which is operable in close clearance situations and in any position or orientation of the machine. In addition, the machine is relatively small in size and light in weight so as to be portable. The drilling and riveting axis of the machine is closely-adjacent the front end portion of the machine frame. The foregoing is provided by the structure and operation of the transfer means 380 which selectively moves the drilling means 240 and rivet inserting and forming means into and out of positional alignment with the work axis 40 and each toward and away from the workpiece. The foregoing also is provided by the structure and operation of the ram and clamp means 44 wherein the first portion 46 is movably carried by the frame main body portion 12 and connected to the motive means 74 and wherein the second portion 48 which moves into and out of contact with the workpiece does not extend beyond the frame front end portion. Rivet blanks are received and held in proper orientation prior to injection into fingers 302 by the combination of the tapered passage 596, air jet from bore 600 and contoured surface surrounding opening 572 which allows machine 10 to operate in any position or orientation.

By way of example, an illustrative machine has a height of about 19.5 inches, a length from front to rear of about 12.5 inches and a width of about 8.5 inches, a weight of about 200 pounds and provides a clamp force of about 200 pounds maximum and an upset force of about 6000 pounds maximum. The machine has an unrestricted front end or head clearance of $\frac{1}{2}$ inch and a throat depth of about 6 inches.

It is therefore apparent that the present invention accomplishes its intended objects. While an embodiment of the present invention has been described in detail, this is for the purpose of illustration, not limitation.

We claim:

1. In a riveting machine, apparatus for maintaining rivets in a predetermined orientation as they are received from a feed tube for subsequent injection into rivet grasping means, each rivet having a head portion, a shank portion of smaller cross-section extending therefrom, and an axis extending longitudinally of said shank portion and each rivet traveling along said feed tube with said shank portion disposed forwardly of said head portion, said apparatus comprising:

(a) means defining a rivet-receiving opening located in a plane, said opening being of a size to receive the shank of a rivet and having an edge formation for supporting the rivet head in a manner such that the longitudinal axis of the rivet is substantially perpendicular to said plane;

(b) means defining a passage leading from said feed tube having a longitudinal axis substantially perpendicular to said plane and said passage converging in a direction toward said rivet-receiving opening for funneling and slowing a rivet traveling toward said opening and preventing flipping and jamming of rivets; and (c) means defining an air jet passage opening to said converging passage for directing a jet of air toward said opening and traversing the path of the rivet traveling toward said opening and disposed at a predetermined angle relative to said plane containing said opening to act on the rivet and hold it in position supported by said opening.

2. Apparatus according to claim 1, wherein the edge formation surrounding said rivet-receiving opening is contoured to avoid flat surfaces and sharp corners which otherwise could cause jamming of rivets.

3. Apparatus according to claim 1, wherein said air jet passage is disposed at an angle of about 65 degrees with respect to said plane.

4. Apparatus according to claim 1, wherein said edge formation surrounding said opening includes at least one surface portion disposed at an angle selected to provide a contour which accepts a rivet without allowing tipping or jamming of the rivet.

5. Apparatus according to claim 4, wherein the edge formation surrounding said rivet receiving opening includes a first surface portion leading from said opening and disposed at a first inclination with respect to the plane of said opening and a second surface portion leading from said first portion and disposed at a second inclination with respect to the plane of said opening, said first and second inclinations being different.

6. Apparatus according to claim 5, wherein said first inclination is greater than said second inclination.

7. Apparatus according to claim 5, wherein said first surface portion defines an angle of about 50 degrees with a plane perpendicular to the plane of said opening and said second surface portion defines an angle of about 60 degrees with a plane perpendicular to the plane of said opening.

8. Apparatus according to claim 1, further including means defining a slot extending from said rivet-receiving opening having spaced apart substantially parallel edges, said edges being spaced apart a distance allowing the rivet shank to pass through and at the same time engaging the rivet head in a supporting manner.

9. Apparatus according to claim 8, further including means defining a pair of transition surface portions between said opening and said edges of said slot.

10. Apparatus according to claim 8, further including movable means for engaging the shank portions of rivets to move the same from said opening along said slot into engagement with rivet holding fingers of said riveting machine.

11. Apparatus according to claim 1, wherein said means defining said converging passage has a first end and a second end of smaller diameter, said first end being in registry with the exit end of said feed tube and said second end being in registry with said rivet receiving opening so that upon leaving said passage a rivet immediately comes to rest in said opening.

12. Apparatus according to claim 1, wherein said air jet passage opens to said converging passage near said rivet-receiving opening.

13. In a riveting machine, apparatus for maintaining rivets in a predetermined orientation as they are received from a feed tube having an exit end for subsequent injection into rivet grasping means, each rivet having a head portion, a shank portion of smaller cross-section extending therefrom, and an axis extending longitudinally of said shank portion and each rivet traveling along said feed tube with said shank portion disposed forwardly of said head portion, said apparatus comprising:

(a) means defining a rivet-receiving opening located in a plane, said opening being of a size to receive the shank of a rivet and having an edge formation for supporting the rivet head in a manner such that the longitudinal axis of the rivet is substantially perpendicular to said plane;

(b) means defining a passage leading from said feed tube having a longitudinal axis substantially perpendicular to said plane, a first end and a second end of smaller diameter, said passage converging in a direction toward said rivet-receiving opening for funneling and slowing a rivet traveling toward said opening and preventing flipping and jamming of rivets, said first end of said passage being in registry with the exit end of said feed tube and said second end being in registry with said rivet-receiving opening so that upon leaving said passage a rivet immediately comes to rest in said opening;

(c) means defining an air jet passage opening to said converging passage near said rivet-receiving opening for directing a jet of air toward said opening and traversing the path of the rivet traveling toward said opening and disposed at a predetermined angle relative to said plane containing said opening to act on the rivet and hold it in position supported by said opening; and (d) said edge formation surrounding said opening including at least one surface portion disposed at an angle selected to provide a contour which accepts a rivet without allowing tipping or jamming of the rivet.

14. Apparatus according to claim 13, wherein the edge formation surrounding said rivet receiving opening includes a first surface portion leading from said opening and disposed at a first inclination with respect to the plane of said opening and a second surface portion leading from said first portion and disposed at a second inclination with respect to the plane of said opening, said first and second inclinations being different.

15. Apparatus according to claim 14, wherein said first inclination is greater than said second inclination.

16. Apparatus according to claim 14, wherein said first surface portion defines an angle of about 50 degrees with a plane perpendicular to the plane of said opening and said second surface portion defines an angle of about 60 degrees with a plane perpendicular to the plane of said opening.

17. Apparatus according to claim 13, further including means defining a slot extending from said rivet-receiving opening having spaced apart substantially parallel edges, said edges being spaced apart a distance allowing the rivet shank to pass through and at the same time engaging the rivet head in a supporting manner.

18. Apparatus according to claim 17, further including means defining a pair of transition surface portions between said opening and said edges of said slot.

19. Apparatus according to claim 17, further including movable means for engaging the shank portions of rivets to move the same from said opening along said slot into engagement with rivet holding fingers of said riveting machine.

* * * * *